US007012544B2

(12) United States Patent
Cunningham et al.

(10) Patent No.: US 7,012,544 B2
(45) Date of Patent: Mar. 14, 2006

(54) ADDRESS AND/OR ALARM INDICATOR SIGN

(75) Inventors: J. Vernon Cunningham, Aurora (CA); Michael Gomes, Cambridge (CA)

(73) Assignee: Cube Investments Limited, Aurora (CA)

( * ) Notice: Subject to any disclaimer, the term of this patent is extended or adjusted under 35 U.S.C. 154(b) by 138 days.

(21) Appl. No.: 10/409,149

(22) Filed: Apr. 9, 2003

(65) Prior Publication Data

US 2004/0201565 A1 Oct. 14, 2004

(51) Int. Cl.
*G08B 5/36* (2006.01)

(52) U.S. Cl. ..... 340/815.55; 340/815.62; 340/815.73; 340/815.74

(58) Field of Classification Search ..... 340/815.4, 340/815.43, 815.44, 815.45, 815.46, 815.47, 340/815.49, 815.53, 815.55, 815.56, 815.65, 340/815.73, 815.74, 815.5; 40/465, 564, 40/576, 580

See application file for complete search history.

(56) References Cited

U.S. PATENT DOCUMENTS 3,553,377 A 1/1971 Jones
3,614,727 A * 10/1971 Fritts ..... 340/905
3,798,375 A 3/1974 Delisle
3,860,762 A 1/1975 Klaiber et al.
3,989,900 A 11/1976 Dibner
4,003,040 A 1/1977 Browand
4,272,901 A * 6/1981 Matthews ..... 40/574
4,425,480 A 1/1984 Lischin
4,442,319 A 4/1984 Treidl
4,491,690 A 1/1985 Daley
4,521,645 A 6/1985 Carroll
4,547,761 A 10/1985 Jones
4,596,900 A 6/1986 Jackson
4,611,265 A 9/1986 Davis
4,686,505 A 8/1987 Vanderburg
4,765,080 A * 8/1988 Conti ..... 40/576
4,791,667 A 12/1988 Havel
4,878,236 A 10/1989 Ray et al.
4,901,461 A 2/1990 Edwards et al.
4,929,936 A 5/1990 Friedman et al.
4,931,780 A 6/1990 LaMont et al.
4,935,951 A 6/1990 Robinson et al.
4,993,058 A 2/1991 McMinn et al.
5,012,507 A 4/1991 Leighton et al.
5,121,126 A 6/1992 Clagett
5,184,116 A * 2/1993 Daugherty et al. ..... 345/109
5,327,493 A 7/1994 Richmond et al.
5,446,440 A 8/1995 Gleason et al.
5,454,181 A * 10/1995 Rothman et al. ..... 40/564
D369,223 S 4/1996 Happer, Jr. et al.

(Continued)

*Primary Examiner*—Van T. Trieu

(57) ABSTRACT

Sign 1 has frame 13 attaching to base 9 and supporting character plates 4. Casing 11 attaches to frame 13 and holds character plates 4 against frame 13. Light assembly 15 and base 9 backlight character plates 4. Backlight is diffusion chamber 17 sidelit by light assembly 15. Casing 11 hides access to the mount and is not easily removable. Light assembly 15 is externally powered and is activated by external messages and by low ambient light. An Emergency Alarm message causes flashing in one colour and intermittent activation of sound. For non-emergency, alternate light mode is used with constant sound. Transmitter 1501 transmits messages for the sign 1. The transmitter 1501 learns emergency telephone numbers for dial detection on a telephone line, in addition to standard emergency telephone number. Emergency button 1507 can begin transmission of emergency alarm message. Transmitter 1501 may have other alarm inputs.

35 Claims, 31 Drawing Sheets

U.S. PATENT DOCUMENTS 5,521,578 A * 5/1996 DelValle ..... 340/330
5,533,286 A * 7/1996 Fallon et al. ..... 40/545
5,548,632 A 8/1996 Walsh et al.
5,548,635 A 8/1996 Bradley et al.
5,617,084 A 4/1997 Sears
5,621,379 A 4/1997 Collins
5,673,304 A 9/1997 Connor et al.
5,734,698 A 3/1998 Kobayashi et al.
5,745,040 A 4/1998 Loughridge
5,748,706 A 5/1998 Morgan et al.
5,790,019 A 8/1998 Edwin
5,790,653 A 8/1998 Fairbanks, Sr. et al.
5,802,112 A 9/1998 Ganter
5,838,771 A 11/1998 Moeller
5,872,832 A 2/1999 Bishel et al.
5,880,672 A 3/1999 Weaver
5,960,061 A 9/1999 Fahie et al.
5,960,337 A 9/1999 Brewster et al.
5,991,363 A 11/1999 Thomson
5,995,847 A 11/1999 Gergen
6,009,148 A 12/1999 Reeves
6,038,262 A 3/2000 Ganter
6,073,005 A 6/2000 Raith et al.
6,098,326 A * 8/2000 Campbell, III ..... 40/575
6,114,948 A 9/2000 Astell
6,205,203 B1 3/2001 Gorman et al.
6,222,455 B1 4/2001 Kaiser
6,252,509 B1 6/2001 Hester
6,289,082 B1 9/2001 Scheiding
6,307,920 B1 10/2001 Thomson et al.
6,367,180 B1 * 4/2002 Weiss et al. ..... 40/580
6,404,874 B1 6/2002 Chestnut
6,471,373 B1 10/2002 Phillips
2001/0009577 A1 7/2001 Orwick et al.
2001/0017911 A1 8/2001 Manner
2001/0017912 A1 8/2001 Baum et al.
2001/0021646 A1 9/2001 Antonucci et al.
2001/0028702 A1 10/2001 Tanaka et al.
2001/0045892 A1 11/2001 Thomas et al.
2002/0001367 A1 1/2002 Lee
2002/0054673 A1 5/2002 Bennett, III et al.
2002/0057764 A1 5/2002 Salvucci et al.
2002/0085684 A1 7/2002 Moore et al.
2002/0085703 A1 7/2002 Proctor
2002/0090061 A1 7/2002 Savaglio et al.
2002/0118797 A1 8/2002 Masuda
2002/0136358 A1 9/2002 Stumer et al.
2002/0136359 A1 9/2002 Stumer et al.
2002/0136360 A1 9/2002 Stumer
2002/0136362 A1 9/2002 Stumer et al.
2002/0136364 A1 9/2002 Stumer et al.
2002/0145514 A1 10/2002 Dawson
2002/0154743 A1 10/2002 Dawson

* cited by examiner

ADDRESS AND/OR ALARM INDICATOR SIGN

FIELD OF THE INVENTION

The invention relates to address indicators and to emergency indicators, such as address signs or alarm signs.

BACKGROUND OF THE INVENTION

Address indicators and emergency indicators are useful to solve many different problems. For example, sometimes it is desirable to signal someone in another room regarding a medical emergency. Hospitals have specific systems to perform this function, often referred to as a call button. It is desirable to have alternative means to indicate an alarm, particularly in non-hospital locations such as a residence.

As another example, finding a residence, particularly in the dark, can be difficult. Often address numbers are in an area that has no light. Even when the area has a light, the light may not be on. Normally being unable to find a residence is an inconvenience. Sometimes it can be life threatening. Emergency personnel can be called to a residence where there is no one to direct them to the premises.

Better illumination of residential address signs is desirable. Many different illuminated address signs have been sold. A recently popular address sign uses multiple light emitting diodes to illuminate house digits as a series of dots. Unfortunately, this type of sign is not visually pleasing.

There have also been many attempts to produce flashing indicators that are activated by the dialling of an emergency telephone number. Some of these indicators have been incorporated into residential address signs. Unfortunately, there continues to be room to improve upon the design of such signs.

SUMMARY OF THE INVENTION

In a first aspect the invention provides a sign having an opaque housing, a radio frequency receiver for receiving messages, a character plate, a backlight, and a sign control circuit. The character plate has an opaque background surrounding one or more translucent characters. The housing has an aperture for the character plate. The housing encloses the backlight and the control circuit. The backlight is for back-lighting the one or more characters. The control circuit is for activating the backlight in response to messages received by the receiver.

The sign may be an address sign with characters that are characters of an address. The sign may be an alarm indicator sign with the characters forming an alarm message.

The backlight may have a light diffusion chamber and a light assembly with one or more light sources for side-lighting the diffusion chamber. The housing may have a base and a frame that form the light diffusion chamber, with the base having a reflective face opposite the housing aperture with the light assembly between the base and the plate, with the frame surrounding and having the same colour as the plate background, and with the frame attached to the base so as not to block light from the light assembly entering the diffusion chamber.

The control circuit may recognize a radio frequency alarm message and activate the backlight in response to the alarm message. The control circuit may recognize a radio frequency emergency alarm message and activate the backlight in an emergency mode in response to an emergency alarm message. The control circuit may also recognize a radio frequency non-emergency alarm message and activate the backlight in a non-emergency mode different from the emergency mode in response to a non-emergency alarm message.

The control circuit may recognize radio frequency messages that are addressed to it. The control circuit may recognize broadcast address messages for learning a specific address for the sign from the broadcast address message.

The light sources may be light emitting diodes (LEDs). The sources may be alternating LEDs of two different colours, one colour for use in indicating an emergency alarm condition, the other colour used to illuminate the characters in low light conditions. The emergency colour may be red and the other colour may be yellow. The LEDs may be mounted on one or more light circuit printed circuits boards. The light circuit printed circuit boards may be retained in slots in the base.

The light assembly may also have a power circuit on a power circuit printed circuit board that is mounted in a slot in the base perpendicular to the light circuit printed circuit board slot, and the light circuit printed circuit boards plug into the power circuit printed circuit board for power.

The sign control circuit may be on a printed circuit board and the control circuit printed circuit board also plugs into the power circuit printed circuit board for controlling power to the power circuit for controlling activation of the light sources. The sign control circuit may have a light sensor and the control circuit printed circuit board may be located in a pocket of the housing optically separated from the light sources.

The sign may also have a casing that encloses the base and frame and retains the character plate against the frame, while providing an aperture through which the characters are visible. The frame may also have a shelf extending partially in front of the diffusion chamber to support the character plate in front of the diffusion chamber. The frame may also have a shelf rim extending outwardly about the shelf to hold the character plate in front of the shelf. A flange may extend from the frame rim in front of the shelf for retaining the character plate between the shelf and the flange within the frame rim. The frame may also have a supra-rim about the frame rim to provide a rim slot, while the casing has a tongue extending rearward that fits into the rim slot.

The sign may have a relatively small depth when compared to its width and height to create a low profile. The sign may have a depth of approximately one inch.

In a second aspect the invention provides a sign having an opaque housing, a character plate, a backlight, and a sign control circuit. The character plate has an opaque background surrounding one or more translucent characters. The housing has an aperture for the character plate. The housing encloses the backlight and the control circuit. The control circuit is for activating the backlight when there is low light external to the sign. The backlight is for back-lighting the one or more characters. The backlight has a light diffusion chamber and a light assembly with one or more light sources for side-lighting the diffusions chamber. The housing has a base and a frame that form the light diffusion chamber. The base has a reflective face opposite the housing aperture with the light assembly between the base and the plate. The frame surrounds and has the same colour as the plate background. The frame is attached to the base so as not to block light from the light assembly entering the diffusion chamber.

In a third aspect the invention provides a sign having an opaque housing, a character plate, a backlight, and a sign control circuit. The character plate has an opaque background surrounding one or more translucent characters. The housing has an aperture for the character plate. The housing encloses the backlight and the control circuit. The control circuit activates the backlight.

The sign may have a receiver for receiving messages, and the control circuit activates the backlight in response to messages received by the receiver. The receiver may be a wireless receiver. The receiver may be a radio frequency wireless receiver. The receiver may be a wired input.

In a fourth aspect the invention provides a transmitter unit for use with an address sign. The transmitter unit has an alarm detector, a radio frequency transmitter circuit, a transmitter control circuit, and a transmitter housing for housing the transmitter circuit and transmitter control circuit. The transmitter control is for recognizing alarms detected by the alarm detector and sending messages to the transmitter circuit in response to a detected alarm. The transmitter circuit is for transmitting those messages over radio frequencies.

The alarm detector may have a telephone decoder for receiving DTMF tones or dial pulses and decoding the DTMF tones or dial pulses into decoded data, and a portion of the transmitter control circuit is for receiving the decoded data and determining when an emergency number has been decoded by the telephone decoder. The telephone decoder may also be for detecting an off-hook condition and decoding DTMF tones or dial pulses begins after detection of an off-hook condition. The transmitter unit may have means for a user to program one or more emergency telephone numbers into the unit for dialling detection.

The alarm detector may have an audible tone detector for detecting an audible tone that represents an alarm. The audible tone detector may be for detecting an audible tone emitted by a smoke detector. The audible tone detector may be for detecting an audible tone emitted by a carbon monoxide detector. The alarm detector may have an input for a security alarm condition.

The transmitter control circuit may have a programmed controller for controlling the operation of the transmitter unit. The transmitter control circuit may be programmed for a plurality of modes of operation, including a Running mode wherein the unit monitors using the alarm detector, and a Program mode wherein the unit receives one or more emergency telephone codes for storage. The transmitter unit may operate in Running mode by default. The transmitter unit may have user input means for activating Program mode. The transmitter control circuit may be programmed for a Learn mode for transmitting a broadcast message to teach a message address to which the transmitter unit addresses messages. The transmitter control circuit may be further programmed for a Reset mode wherein one or more stored telephone codes are deleted from the transmitter unit.

In a fifth aspect the invention provides a sign and transmitter combination with or without radio frequency transmission.

In a sixth aspect the invention provides a kit having a sign with casing and character plates provided detached from other components of the sign for later assembly. The kit may also have a transmitter unit.

Other aspects and embodiments of the invention are set out elsewhere herein, or will be evident to those skilled in the art based on the principles presented herein, including methods by which the above aspects may operate.

BRIEF DESCRIPTION OF THE DRAWINGS

For a better understanding of the present invention and to show more clearly how it may be carried into effect, reference will now be made, by way of example, to the accompanying drawings which show the preferred embodiment of the present invention and in which.

DETAILED DESCRIPTION OF THE PREFERRED EMBODIMENT

In this description direction is typically determined with reference to a sign 1 as it would normally be installed: on a substantially vertical surface external to a dwelling or location where people may be present. It is to be understood that this does not mean that the sign is necessarily visible outside a building. For example, the sign could be mounted outside an individual apartment in a hallway, or simply outside a room. Left, right, front, back, top, bottom and other like terms are used from the perspective of a person facing the sign 1. This convention is not intended to limit the ways in which the sign 1 may be used or located; rather, it is used to assist the reader in understanding the concepts described herein. Throughout this description the term "character" is used. It is to be understood that characters for some signs include non-number alphanumeric characters, for example, an outside entrance to a unit of a house may have address characters "72A", or a full address "72 Main St." may be used or simply an address number may be spelled in full such as "Seventy-Two". Where the sign 1 is mounted outside an individual apartment, the address may consist of the apartment characters. Alternatively, the sign 1 may display a message formed from multiple characters, such as alarm sign 1 with the characters "HELP". The term "character" as used herein includes any such alphanumeric character in any language or format.

Figure 1:
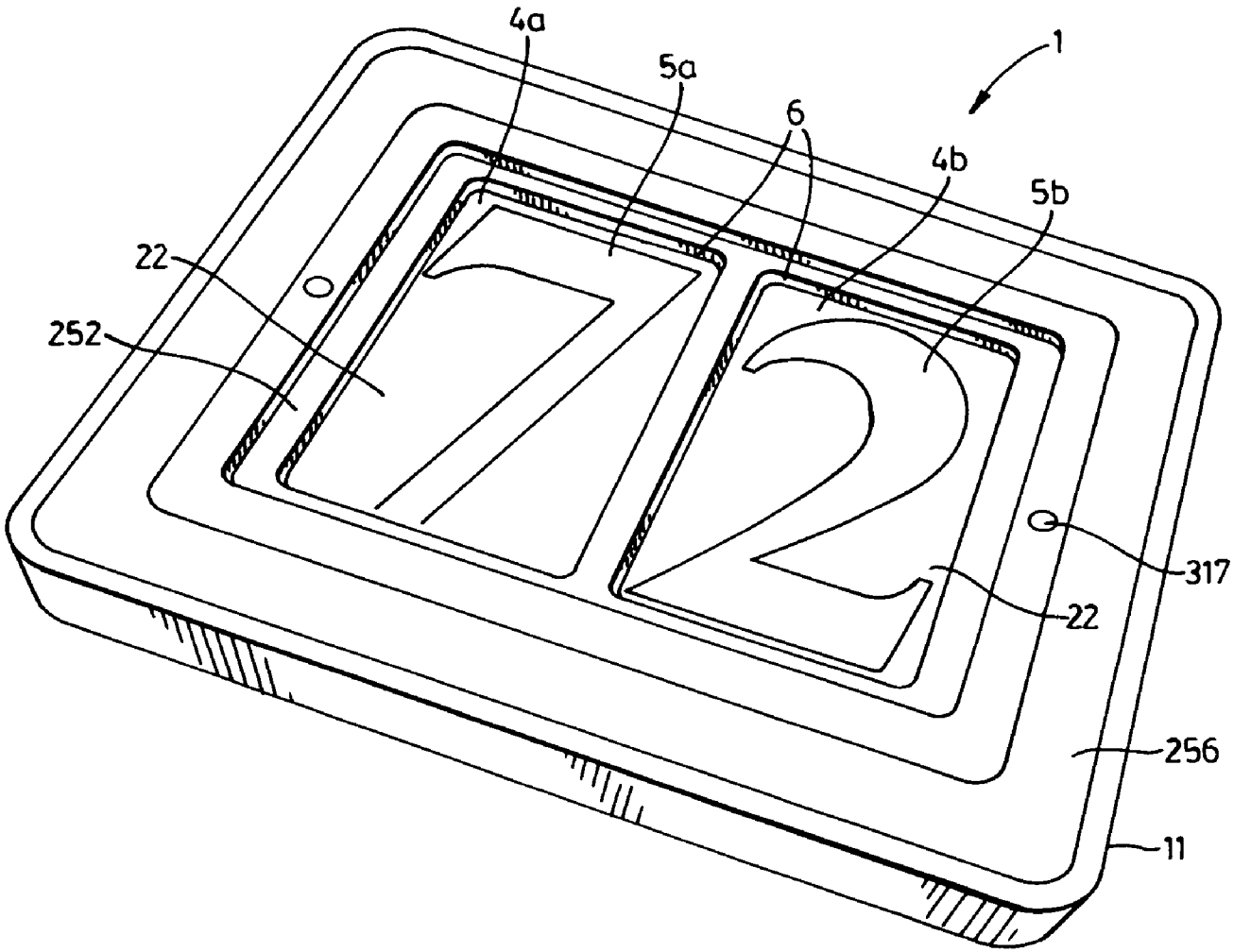
FIG. 1 is a perspective view of a sign in accordance with the preferred embodiment of the invention.

Referring to FIG. 1 asign 1 (in this case an address sign) has a housing 3, character plates 4 and characters 5. The sign 1 also has a light sensor opening 7. The sign 1 has two character plates 4*a*, 4*b* (collectively referred to as 4) and characters 5*a*, 5*b* (collectively referred to as 5); however, the preferred embodiment is in no way limited to two character plates 4 or one character 5 per plate 4. The characters 5 are visible through apertures 6 in the housing 3.

Figure 2:
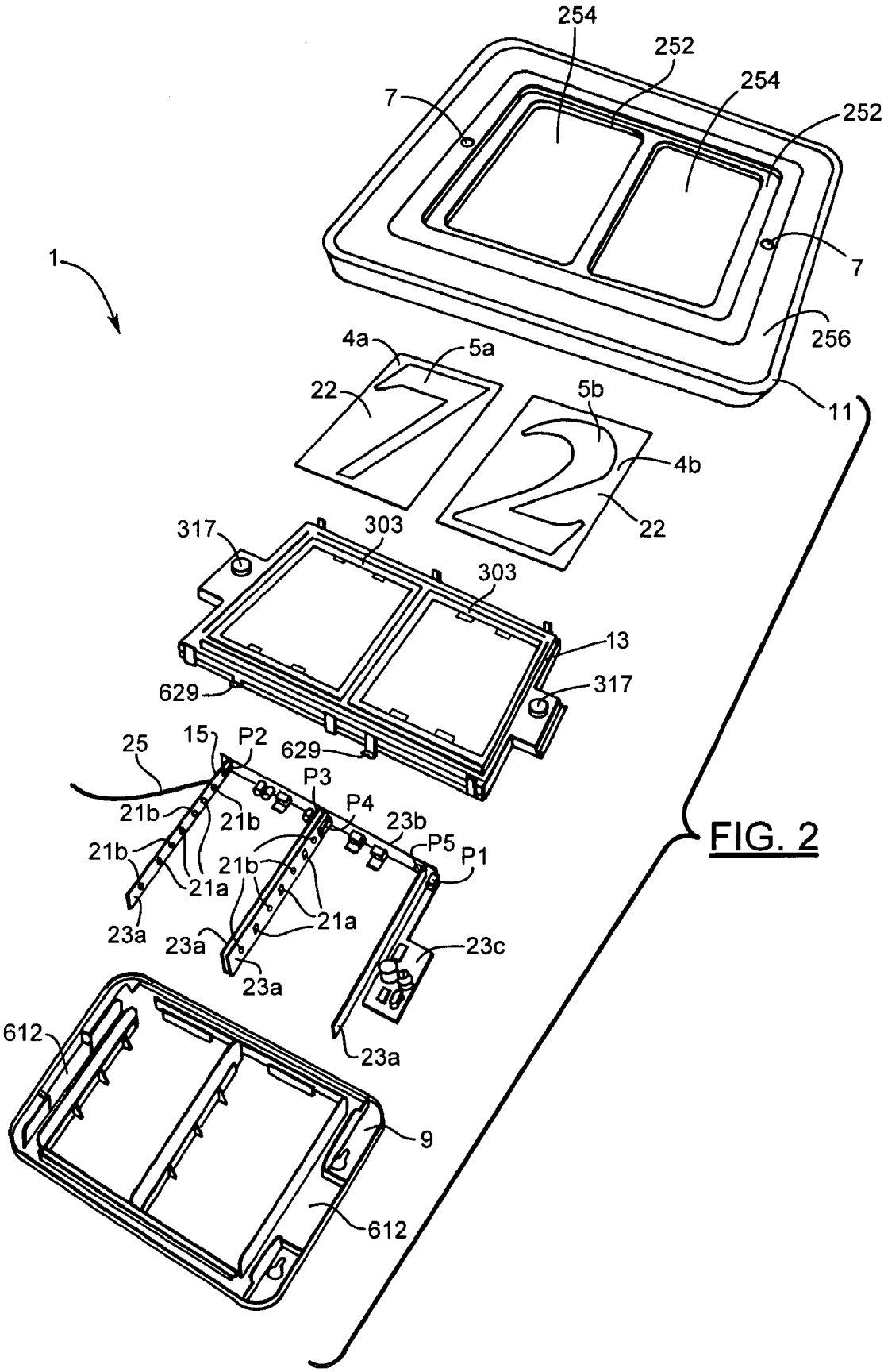
FIG. 2 is an exploded perspective view of the sign of FIG. 1.

Referring to FIG. 2, the housing 3 is made up of a base 9, casing 11 and support frame 13. The sign 1 also has a light assembly 15 that fits between the base 9 and frame 13.

Figure 3:
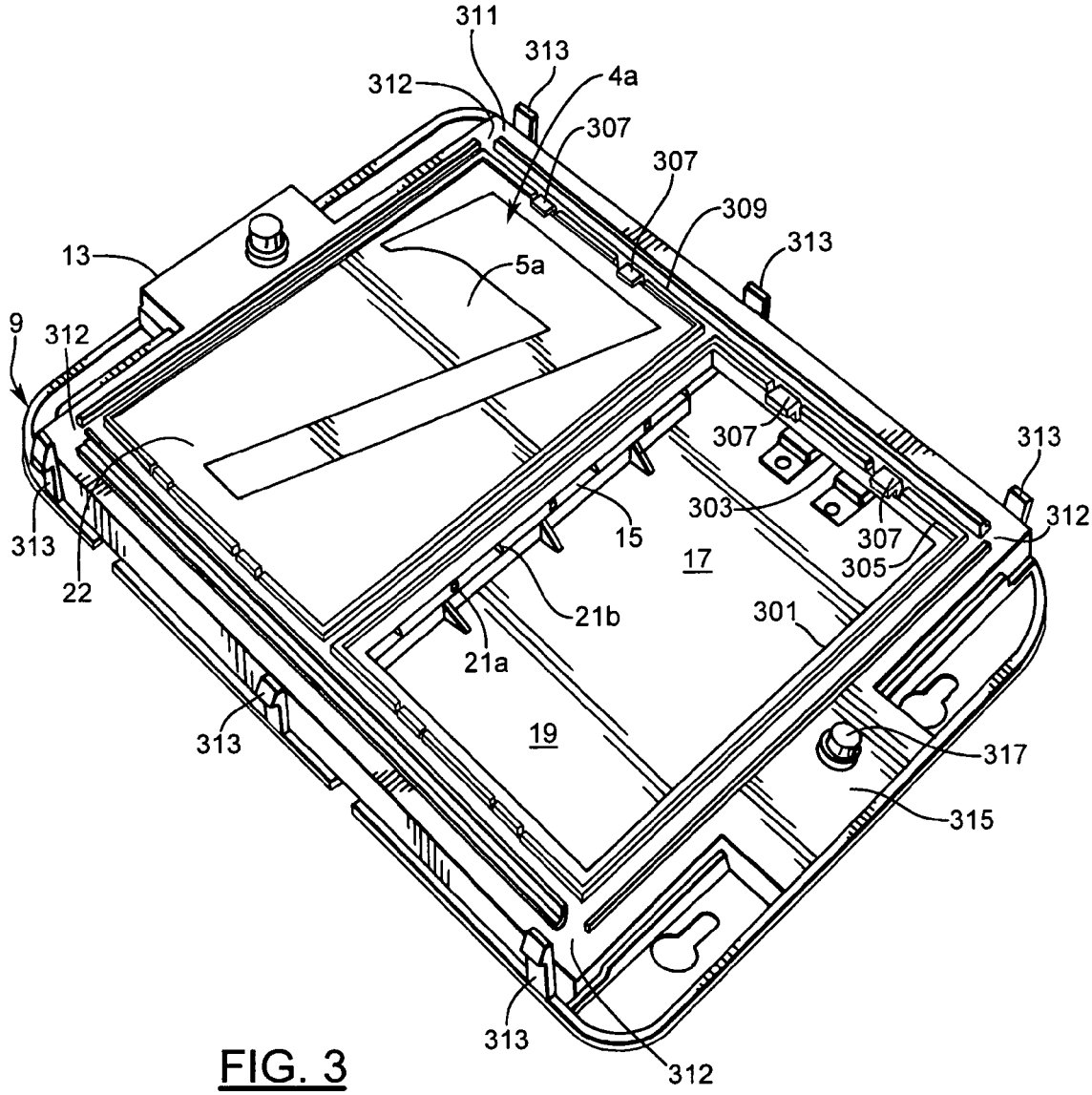
FIG. 3 is a perspective view of the sign of FIG. 1 with its casing and a character plate removed.

Referring to FIG. 3, the base 9 and frame 13 create a series of diffusion chambers 17, one of which is shown in FIG. 3. Another diffusion chamber 17 is enclosed by character plate 4*a*. In use, a character plate 4 encloses each diffusion chamber 17. The base 9 has a reflective face 19 that opposes the character plates 4. The base 9 and frame 13 are made of any opaque material, such as an opaque mouldable plastic, that, together with the character plates 4 substantially encloses the diffusion chamber, and thus the diffusion chambers are substantially covered by an opaque material.

The character plates 4 have an opaque background 22 surrounding the characters 5. The characters 5 are translucent. The character plates 4 may be easily fabricated from a translucent plastic sheet with the background 22 film-coated on one side of the sheet to outline the translucent characters 5.

For best daytime viewing, the colour of the characters 5 should contrast significantly with the colour of the background 22. In the preferred embodiment the characters 5 are white and the background 22 is black.

The light assembly 15 provides a light source 21 to side-light the diffusion chambers 17. Some light from the light source 21 reaches the characters 5 directly at an angle, while other light is reflected within the diffusion chamber 17 and reaches the characters 5 indirectly. This provides relatively even lighting across the character 5 from the diffusion chamber 17. The light sources themselves are behind the frame 13 and the background 22 and are not directly viewable from in front of the sign. In addition the characters are translucent which hides some of the pinpoint brightness of the light sources 21.

Referring to the Figures generally, as has been and will be described, frame 13 attaches to base 9. Frame 13 supports number plates 4 over base 9. Casing 11 attaches to frame 13 and holds number plates 4 against the frame 13. The casing 11 fits snugly about the base 9 and against the number plates to provide weather-resistance. The light assembly 15 and base 9 provide a backlight for the character plates 4. The backlight is provided by base as a diffusion chamber 17 sidelit by the light assembly 15.

The base 9 is mountable on a surface, preferably a substantially vertical surface, not shown. The casing 11 preferably hides access to the mount and is not easily removable once attached to the remainder of the sign 1.

The light assembly 15 is externally powered and is activated in response to external radio frequency wireless messages and in response to low ambient light conditions. As the sign 1 receives radio frequency messages there is no need to have wires connected directly to the source of the messages. This significantly eases installation and provides a great deal of flexibility if the location where the sign 1 can be mounted. Provided the source of the radio frequency message is within range, the sign 1 can be located close to the street or on a prominent face of a house, for example, above a garage door. Messages are wireless communication addressed and can set the sign into a number of different modes, including: Learn, Emergency Alarm, and Non-Emergency Alarm. The sign 1 runs in Running mode by default once powered up.

In Running mode the light assembly is off until low light conditions are sensed, after which the light assembly illuminates constantly in a pleasing colour contrasting with the background of the character plates 4, yellow has been found to be quite effective. When the sign receives an Emergency Alarm message light assembly flashes on and off in a colour that might indicate emergency (such as red) and rapid periodic activation of a sound (such as a buzzer). Red on and off flashing is both attractive and may be commonly recognized as a state of alarm. It may be worthwhile for a user of the sign 1 to educate those in the vicinity that when the sign flashes red it is indicating an emergency condition. For a non-emergency condition an alternate light mode is used that combines flashing of the normal running colour of the sign 1 and constant sound activation. After an alarm condition occurs, the sign 1 continues flashing until it receives a further signal to change modes. In Learn mode the sign 1 responds to a broadcast message to receive a new wireless communication specific address for the sign 1.

Referring to FIG. 2, the light source 21 may comprise a plurality of light sources 21*a*. In the preferred embodiment, LEDs are used as the light sources 21*a*. LEDs are inexpensive, plentiful and now provide high luminance for low power. They are small and typically do not generate much heat. They can be directly mounted on a printed circuit board. They are easily controllable and provided quick on-off characteristics with long life.

For a simple sign without emergency features, a single colour LED 21*a* can be used. If emergency features, such as those to be later described, are to be used then single LEDs of multiple colours 21*a*, 21*b* can be used. Additional colours, not shown, can also be used to distinguish different emergency states. In the preferred embodiment red has been chosen as the colour for the light sources 21*b*. Typically the light sources 21*b* are flashing in emergency situations, perhaps including alternating flashing with the light sources 21*a*. Thus, it is helpful for the light sources 21*b* to contrast significantly with the colour of the light source 21*a*.

The light sources 21*a* are used to illuminate the characters 5 constantly in non-emergency low light conditions, for example, at night. Again, the colour of the light sources 21*a* should be chosen to contrast significantly with the backgrounds 23 when illuminated. For the preferred embodiment the light source 21*a* colour is yellow.

The light assembly 15 has a series of printed circuit boards 23, namely: light boards 23*a*, power board 23*b* and control board 23*c*. There is a light board 23*a* on either side of the diffusion chamber 17. As there are two diffusion chambers 17 in sign 1, there are four light boards 23*a*.

Many alternative light assemblies could be used. For example, the number of boards could be reduced or the light sources could be separately mounted. The configuration of the light assembly 15 of the preferred embodiment has been found to be particularly effective as it provides a stable structure that can be easily assembled.

Figure 4:
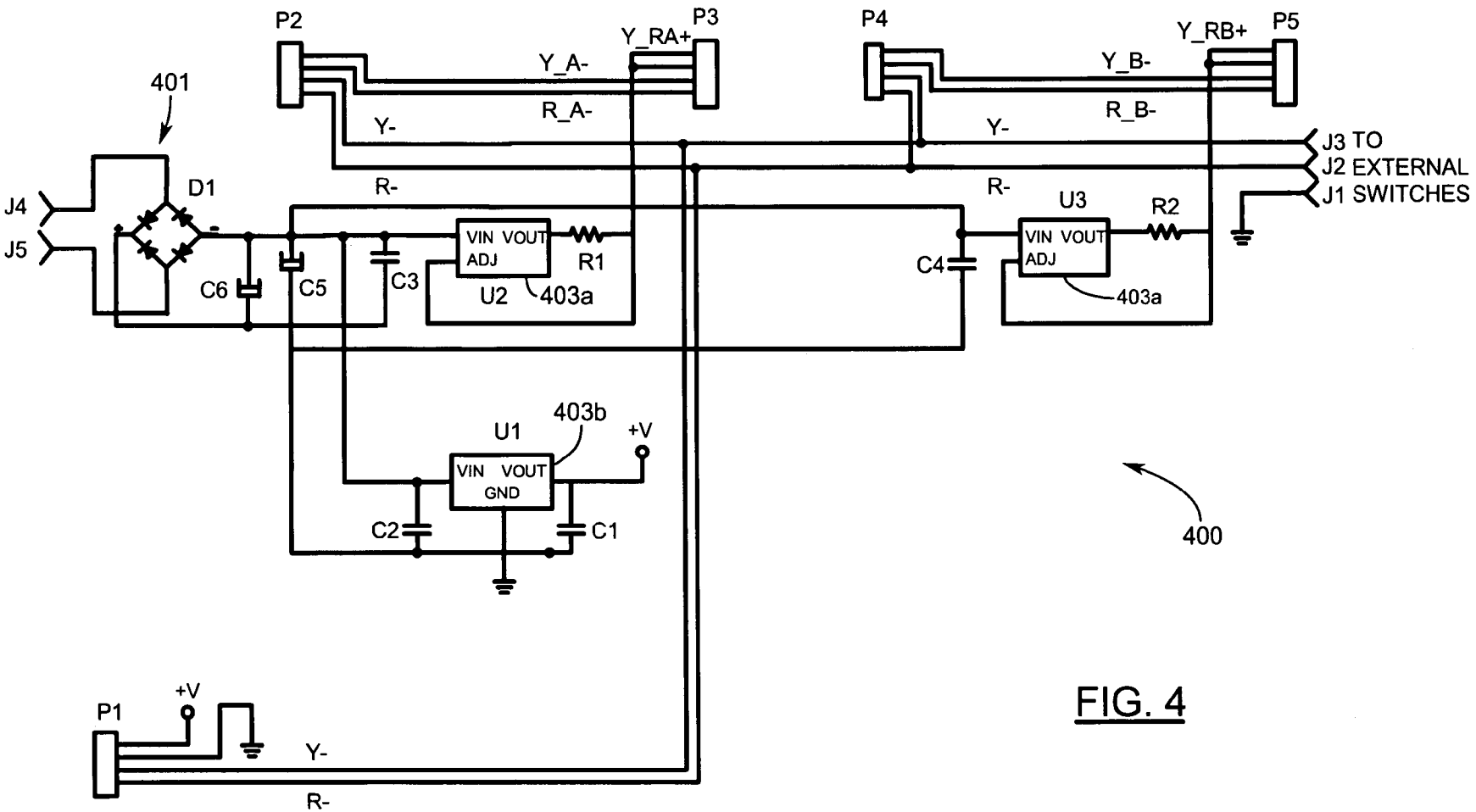
FIG. 4 is a schematic diagram of a power circuit used in the sign of FIG. 1.

The light boards 23*a* plug into the power board 23*b* at connectors P2, P3, P4, P5. The control board 23*c* plugs into power board 23*b* at connectors P1. The power board 23*b* receives power through wires 25 to connectors J4, J5 (FIG. 4). In the preferred embodiment incoming power is nominal 20 VAC from a wall plug adaptor (a "wall wart"), not shown. Preferably only low voltage power is brought to the sign 1 in order to reduce the possibility of electric shock and to limit the need for protective measures at the sign 1. The sign may have battery backup; however, this would require changing of batteries which may be difficult if the sign 1 is not easily accessible and because the sign 1 has been provided with features that make accessing the interior of the sign 1 difficult after installation of the casing, to reduce the possibility of tampering.

Referring to FIG. 4, a power circuit 400 on power board 23*b* rectifies and regulates the incoming power at J4, J5 using full bridge rectifier 401, voltage regulators 403*a* (adjustable by setting R1 to provide the current required across the light sources 21*a*, 21*b*), 403*b* (source voltage for power board 23*b* and control board 23*c* components, typically 5 VDC). One voltage regulator 403*a* is provided for each pair of light boards 23*a* for a given diffusion chamber 17.

Figure 5:
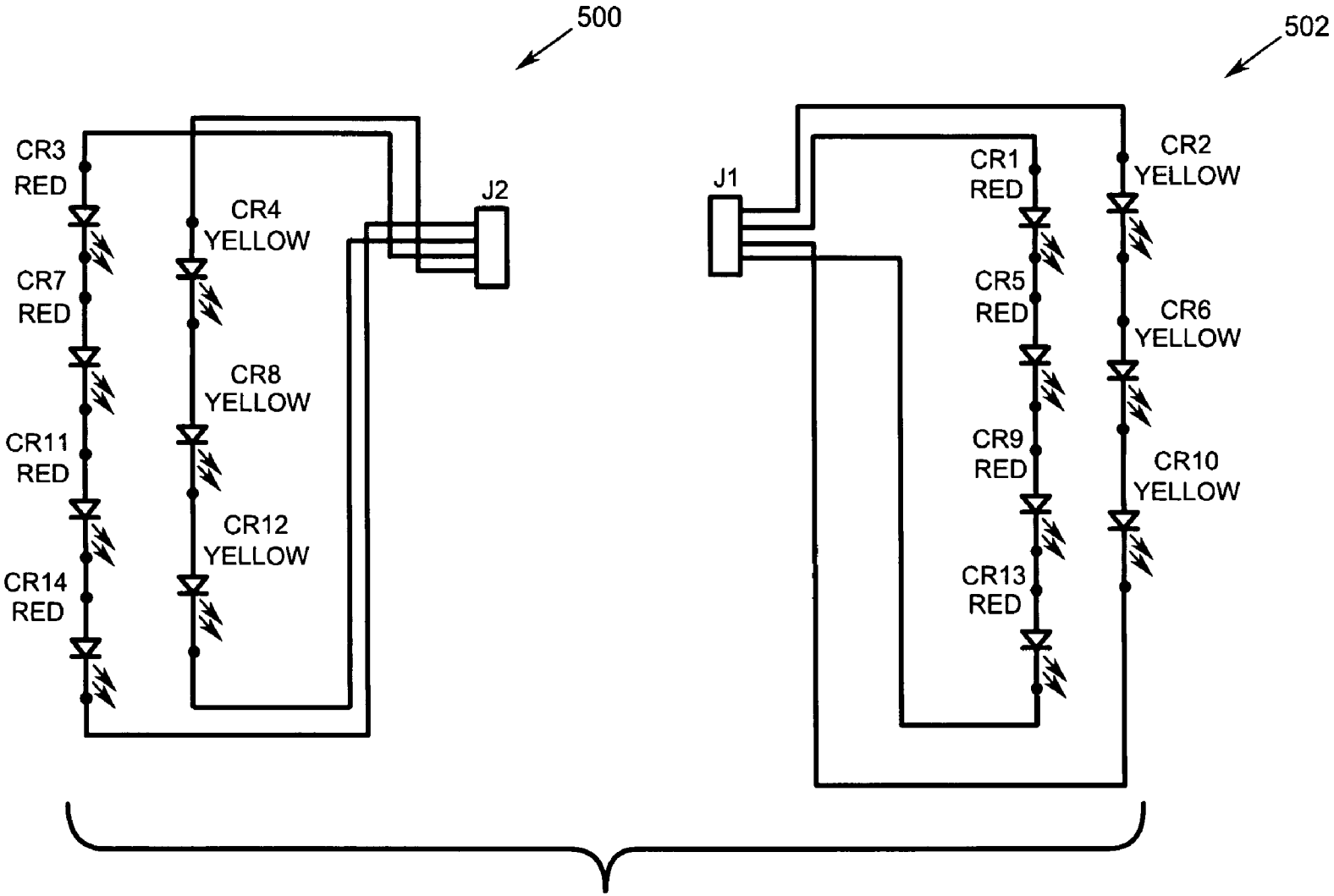
FIG. 5 is a schematic diagram of left and right light circuits used in the sign of FIG. 1.
Figure 6:
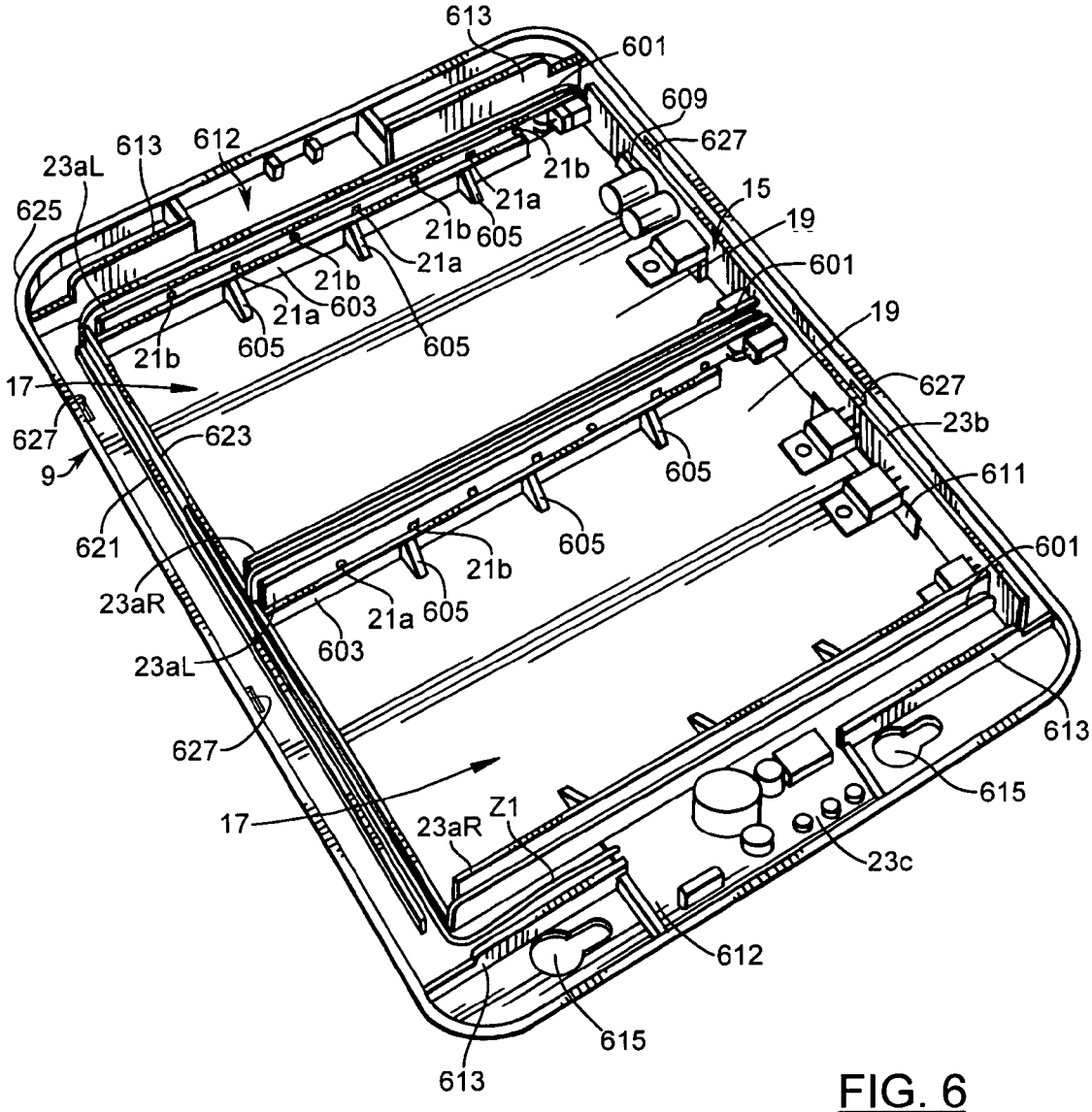
FIG. 6 is a perspective view of a base and light assembly of the sign of FIG. 1.

Referring to FIGS. 5 and 6, light board 23*a* has two forms 23*a*L, 23*a*R one for either side of a diffusion chamber 17. Although light circuit 500 for board 23*a*L is identical to light circuit 502 for board 23*a*R, the physical layout is different, as can best be seen with reference to FIG. 6.

Referring to FIG. 6, the base 9 has regularly spaced dividers 601 extending substantially perpendicular to reflective face 19 that divide one diffusion chamber 17 from the next. Within each diffusion chamber 17 adjacent to, but spaced away from, each divider 601 is a parallel retaining wall 603. The retaining walls 603 do not extend as far from the reflective face 19 as the dividers 601. The walls 603 have buttresses 605 facing the diffusion chamber 17 for support. The light boards 23*a* fit in the slot between divider 601 and wall 603, and are retained from rotational and sideways movement thereby. The light sources 21*a*, 21*b* are placed on an upper portion of light board 23*a* to project over the wall 603 in order for light to enter the diffusion chamber 17. In the Figure not all of the light sources 21 are shown or have been provided with reference numerals. For example, the light sources 21 on light boards 23*a*R are not evident because of the perspective from which the Figure is shown. To avoid unduly cluttering the Figure only nine of the fourteen light sources 21 that are evident have been provided with reference numerals.

As the wall 603 reaches above a point where the light sources 21 would be if centered on the boards 23*a*, the light sources 21 are placed off center on the boards 23*a*. As the boards 23*a* are connected at one end by connector P2, P3, P4 or P5 to the power board 23*b*, the light boards 23*a* cannot simply be rotated end to end. Thus two different boards 23*a*L, 23*a*R have been used. Other alternative structures could have been used, for example, a connector could have been placed on both end of the boards 23*a*, allowing for connection at either end.

The light sources 21*a* of one colour are equally spaced along the light boards 23*a*. The light sources 21*b* of another colour are also equally spaced from one another along light board 23*a*. The light sources 21*a* and 21*b* in the preferred embodiment have different operating voltages. The light sources 21*a* operate at approximately ⅔ the voltage of the light sources 21*b*. Although it is not necessary to align the light sources 21*a*, 21*b* in an alternating pattern containing three light sources 21*a* and four light sources 21*b*, it has been found to provide an adequate lighting and a please professional appearance, while simplifying the powering of the boards 23*a*. Of course, alternate physical light source layouts and circuit configurations can be used to provide signs embodying the principles described herein as will be evident to those skilled in the art. Such alteration may be necessitated, for example, by the choice of differing light source components that have different light output or different operating characteristics. Alternatively, dual colour LED light sources 21 could be used in place of single colour light source 21*a*, 21*b*.

The power board 23*b* is held in place perpendicular to the light boards 23*a* in a slot between retaining walls 607, 609, 611 and by the light boards 23*a* that restrict movement.

The base 9 also has opposing pockets 612 at either end outside the end dividers 601*a*, 601*b*. Separators 613 separate the pockets from keyhole openings 615. Keyhole openings 615 are used to mount the back and, thus, the sign 1, for example on screws, not shown, when in use. As will be evident to those skilled in the art with use of this description, many other mounting means can be used. The control board 23*c* fits in the pocket 612*a* and is retained thereby. The other pocket 612*b* is empty in the preferred embodiment for use possibly with future extensions.

Flexible wire antenna Z1 extends from control boards 23*c* into trough 617 between retaining walls 621, 623. Retaining wall 621 also retains the bottom of the light boards 23*a*. Thus, the base 9 retains the light assembly 15 and substantially prevents any side to side or up and down movement.

The base 9 has an outer rim 625 with a plurality of retaining openings 627. The frame 13 has a corresponding plurality of hooked tabs 629 (FIG. 2) that snap into the base openings 627 such that the frame 13 snaps into the base and is attached thereto (FIG. 3). The frame 13 can be released from the base by pushing the tabs 629 inwardly.

Referring to FIG. 3, the frame 13 has a sub-frame 301 with a shelf 303 extending over the diffusion chamber 17 to support the character plate 4 and a rim 305 to retain the character plate 4. The rim 305 may have one or more flanges 307 that extends inwardly over the shelf 303 to prevent tilting of the character plate 4 away from the shelf 303. In the preferred embodiment flanges 307 have only been provided along the top of the sub-frame 301 as the bottom of the character can be held in by friction against the rim resulting from gravity pulling down the character plate, provided that the frame 13 is not tilted far past vertical or shaken.

A supra-rim 309 extends about and slightly spaced away from the sub-frame rim 305 to define a slot 311 between the rims 305, 309. The supra-rim 309 has open corners 312 for ease of manufacturing and placement of the casing 11. The slot 311 also extends between the rims 305 of adjoining sub-frames 305. The slot 311 is used to receive a corresponding tongue, not shown, extending from the back of the casing 11. The frame also has forwardly extending hooked tabs 313 that snap into openings, not shown, in the rear of casing 11. The openings are not accessible from the front of the casing 11 to prevent easy removal of the casing 11 (tampering) from the frame once the casing 11 is mounted on the frame 13. For this reason, the sign 1 can be provided in the form of a kit with the base and frame connected and the light sources mounted, but the casing left off in order to allow access to the base for installation purposes. Also, this permits proper selection and insertion of characters prior to installation. A kit may or may not include a transmitter unit 1501 (see later description). The casing 11 frame 13 combination provides a snug, centered, light-tight fit between the casing 11 and the frame 13. This fit is also weather-resistant as water hitting the character plates 4 will generally not enter past the supra-rim 309 and will be pulled downwardly by gravity to flow back over the casing 11 or through open corners of the supra-rim 309. Any water between the rims 305, 309 will eventually evaporate. The power board 23*b* is placed at the top of the sign 1 to further limit the possibility that it may sit in water that enters the sign 1.

The frame 13 has a cover section 315 that extends outwardly from the shelf 303 and then downwardly so that it rests on the outer rim 625 and covers the light assembly 15, while allowing access to the mounting openings 615 for installation. The cover section 315 has clear outwardly extending light sensor covers 317. Other embodiments can use less or more sensor covers 317 depending on the number of light sensors used. The sensor covers 317 extend far enough to be flush with the external surface of the casing 11. Between the shelf 303 and the light sensor covers 317, the frame 13 has rearward projecting tongues for overlapping outside the dividers 601 to block light transfer from the diffusion chamber 17 to the pockets 612.

Referring to FIG. 2, the casing 11 has openings 7 for loosely receiving the sensor covers 317. Thus, when the casing 11 is mounted light flows through the openings 7 and the sensor covers 317 over the pockets 612. The pockets 612 prevent sufficient light from entering to activate the light sources 21. The casing 11 has sub-frames 252 with apertures 254 (that provide apertures 6, FIG. 1) that generally match the area within the shelves 303. When assembled, the sub-frames 252 cover the area of the frame 13 between the character plates 4, while extending over a portion of the character plates 4. The casing 11 incorporates the sub-frames 252 and extends outwardly and rearward to enclose the remainder of the sign 1, including frame 13 and base 9. For different aesthetic designs, the casing 11 can have different profiles and may extend well beyond the area of the base 9. For this purpose the casing 11 may be substantially hollow behind its front face 254. The casing 11 may have a trim insert 256 that fits within the remaining profile of the casing 11. This allows for manufacturing access to features of the casing 11, including the openings that receive the tabs 313 from the frame 13. The trim insert 256 may be glued or otherwise bonded to the remainder of the casing 11.

The casing 11 preferably wraps around the sign 1 to snugly receive the base 9. This provides weather-resistance from water entering from behind the sign 1. It is to be remembered that the sign 1 is intended for installation fairly tight against a substantially vertical surface. This in itself limits the possibility of water entering from the rear. Water will tend to flow downwardly around the sign 1. If water enters between the base 9 and the casing 11, the water will again tend to flow downwardly about the base 9 and frame 13 and exit at the bottom of the sign 1. If desired, water-tight seals (such as rubber gaskets, not shown) could be provided between the casing 11 and the frame 13 and between the base 9 and the casing 13; however, this will not be necessary in most installations. It also has the disadvantage of increasing costs, difficulty of installation and trapping moisture in the sign 1 that may corrode or otherwise damage the sign 1.

The sign 1 can have a pleasing low profile. The depth of the sign 1 for the preferred embodiment is approximately 1 inch. The base 9 is approximately 6¼ inches by 8¾ inches. The characters 5 are approximately 2½ by 4¼ inches and the character plates 4 are approximately 3 by 4¾ inches.

Preferably the base 9, casing 11 and frame 13 are each injection moulded out of a hard plastic.

Figure 7:
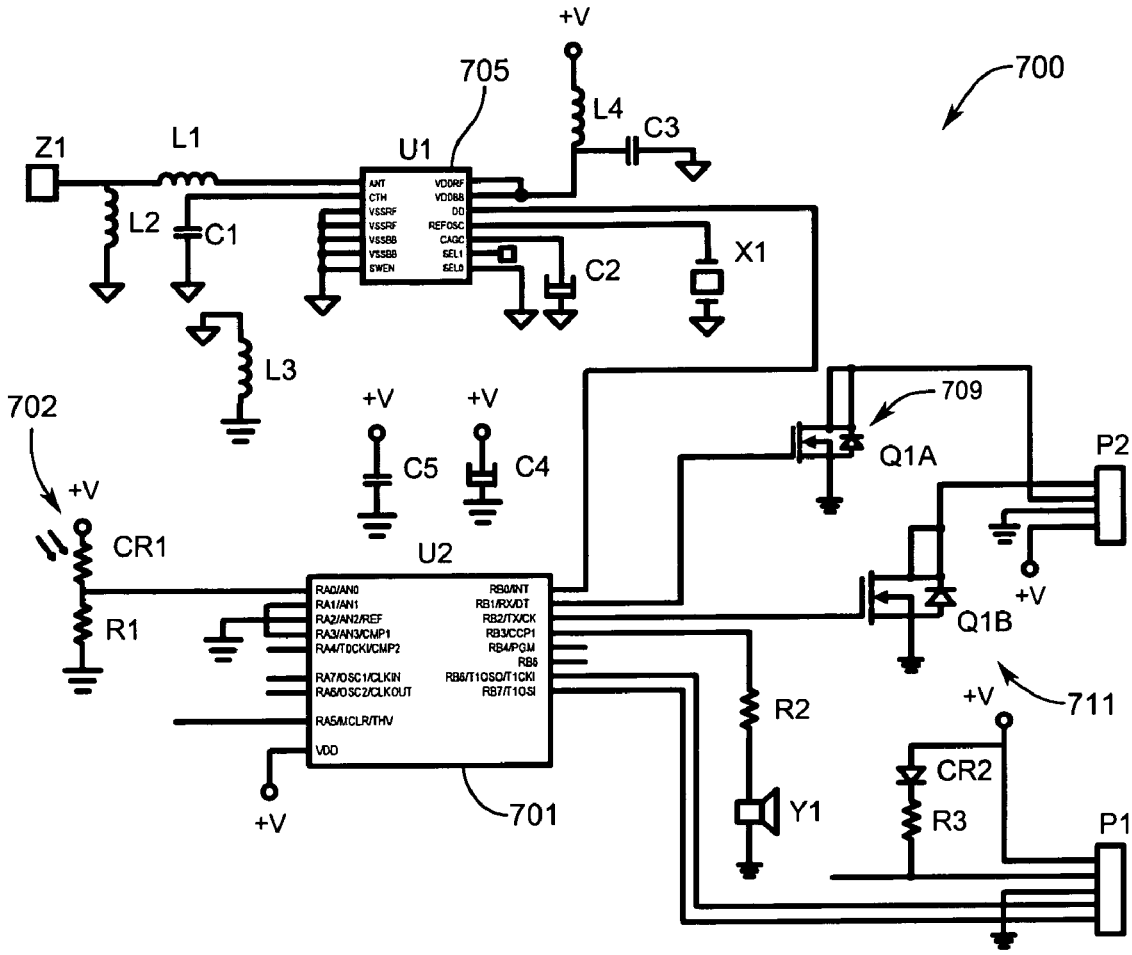
FIG. 7 is a schematic view of a control circuit used in the sign of FIG. 1.

Referring to FIGS. 6 and 7, control circuit 700 on control board 23*c* has a controller 701, such as a PIC 16F628 programmable microcontroller. Although a microcontroller is particularly well suited to the tasks described herein due to its low cost, and ease of assembly and programmability, it is not necessary to use this particular microcontroller or any microcontroller.

For example, a less or more powerful integrated circuit could be used, or a control circuit could be made up of a combination of discrete components. The controller 701 is connected to a light sensor 702, a radio frequency wireless receiver 705, a buzzer 707, and two switches 709, 711.

The light sensor 702 is positioned so that light incoming through its associated sensor cover 317 strikes the sensor 702. The wireless receiver 705 is constantly checking signals received at antenna Z1 as filtered by inductors L1, L2. The receiver 705 is tuned to listen for signals at approximately 433 MHz. Of course, other frequencies could be used as desired and as permitted by regulatory authorities.

For non-alarm features, the wireless receiver 705, buzzer 707 and switch 711 are optional. In fact, in non-alarm situations, the controller 701 could be optional as well. The light sensor 703 could be configured to directly control the switch 709.

Figure 8:
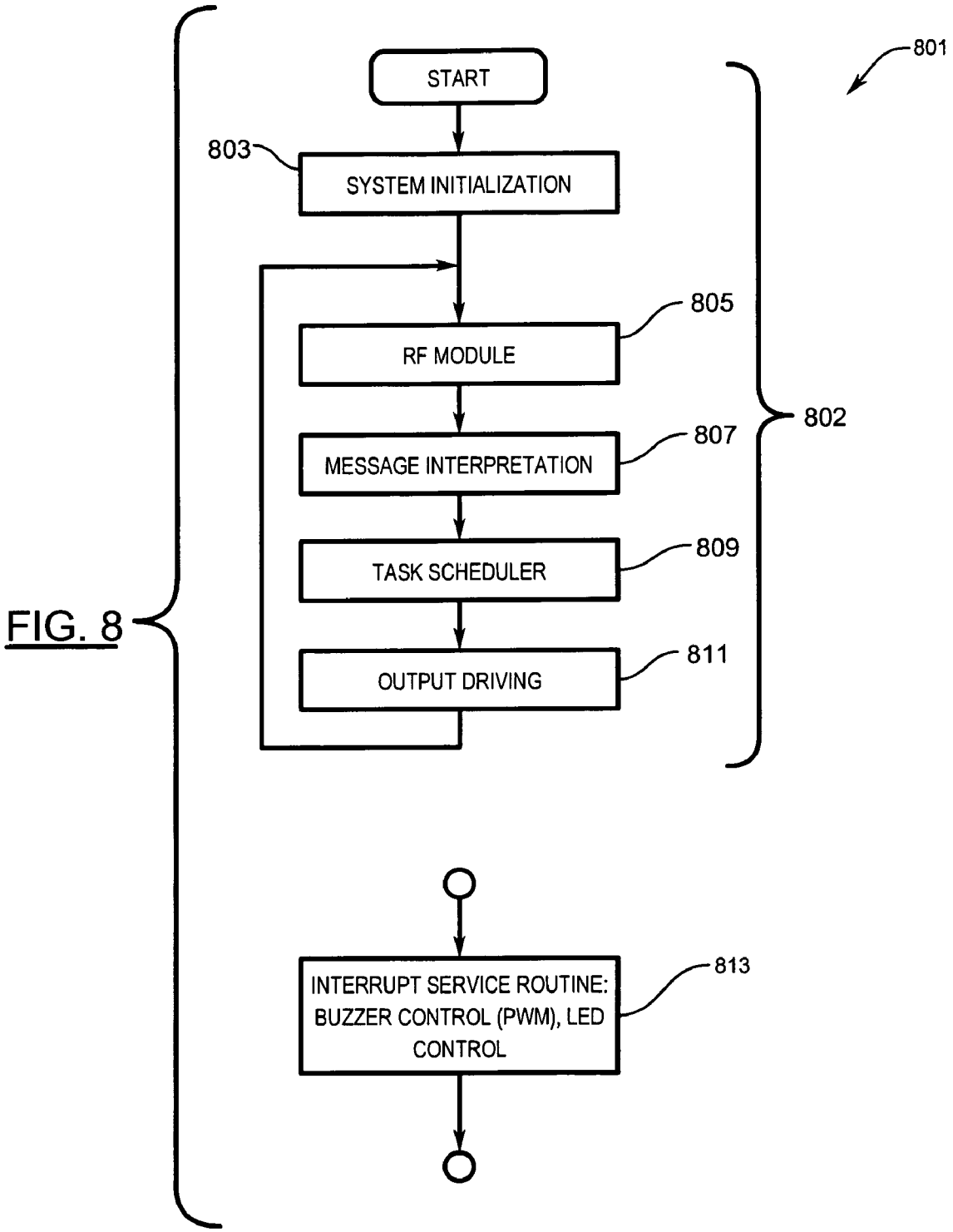
FIG. 8 is a flow diagram of a main module and interrupt service routine used in the control circuit of FIG. 7.

Referring to FIG. 8, the controller 701 contains a program 801 that controls the operation of the controller 701. Those skilled in the art will now how to program controller 701 or other similar controllers to provide the operations described herein. Some aspects of the program used in the preferred embodiment will now be described in further detail.

The program 801 has a main module 802 with a number of basic routines: system initialization 803, RF module 805, message interpretation 807, task scheduler 809, and output driving 811.

The program 801 also has an interrupt routine 813. The program 801 executes the main module, unless an interrupt occurs to trigger execution of the interrupt routine 813.

Figure 9:
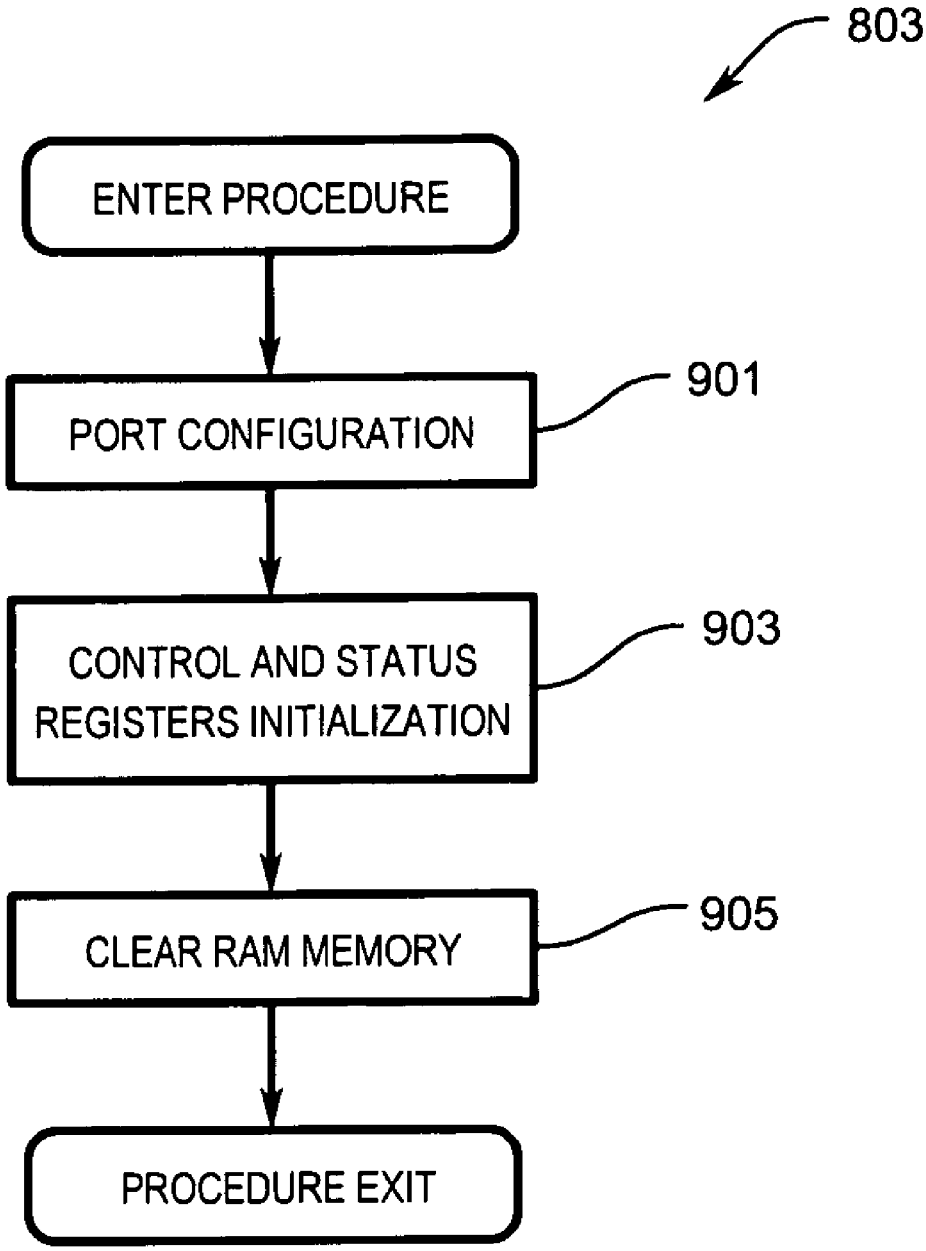
FIG. 9 is a flow diagram of a receiver initialization routine used in the main module of FIG. 8.

Referring to FIG. 9, when the sign 1 is provided with power the program 801 performs system initialization by performing port configuration at 901, initializing control and status registers at 903, and clearing random access memory (RAM) at 905.

Figure 10:
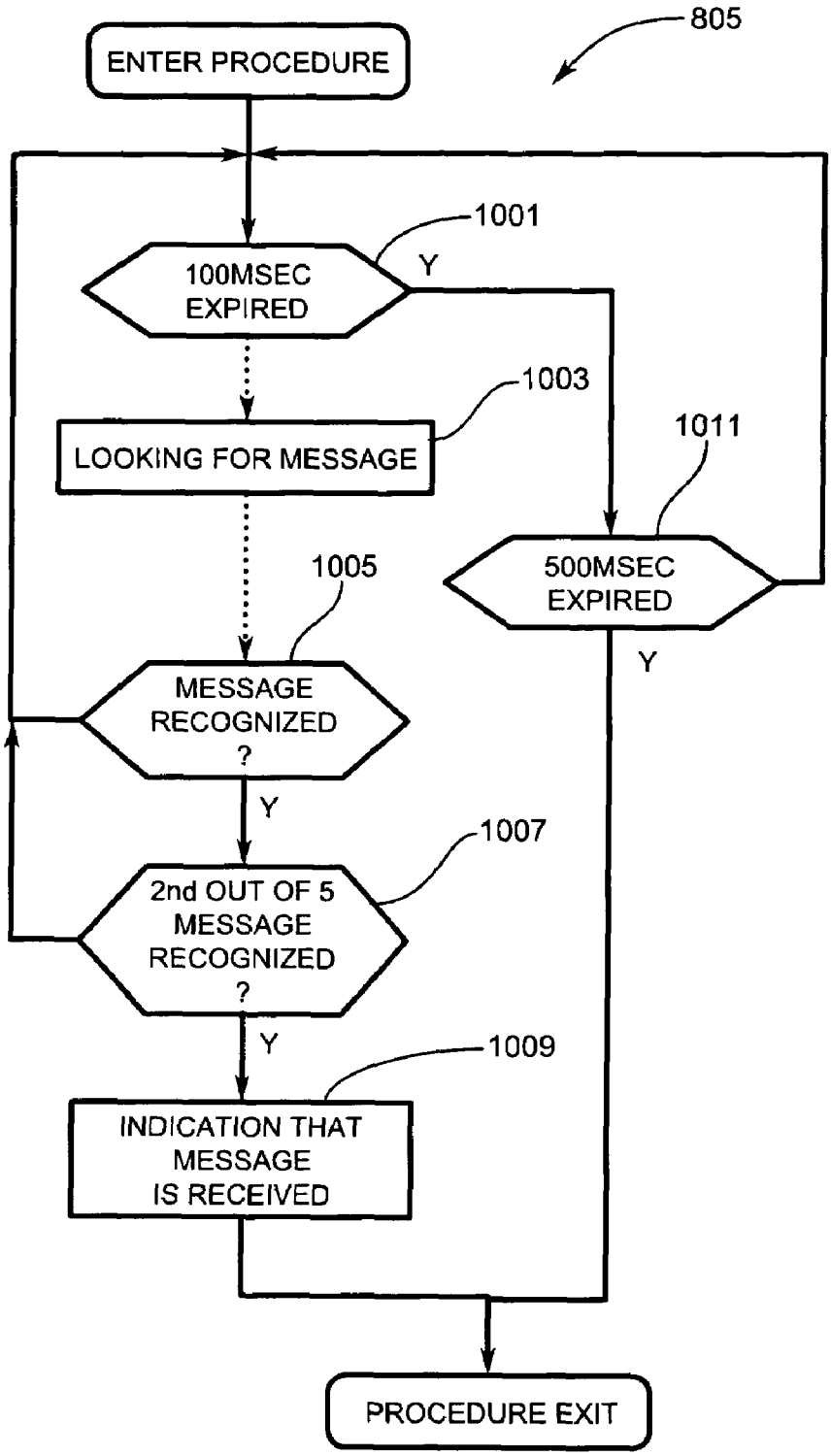
FIG. 10 is a flow diagram of a receiver radio frequency routine used in the main module of FIG. 8.

Referring to FIG. 10, the program 801 then executes the RF routine 805 in an attempt to recognize 2 out of 5 messages in a 500 msec window. The routine 805 times at 1001 for 100 msec while looking for a message at 1003 from wireless receiver 703. When a message is received at 1005 then the routine 805 asks if this is the second message received during a 500 msec window at 1007 and if not the routine 805 repeats the process of looking for another message. If a second message is recognized then the routine 805 indicates at 1009 that a message has been received at the controller 701. Whenever the 100 msec timer times out, the routine 805 asks at 1011 if it has been 500 msec since the routine began, and, if so, the routine 805 ends without an indication that a message has been received.

If the preferred embodiment, a message as the following form: 1 sync bit, 10 address bits, 2 command bits, and a separation pulse. A "1" bit is a long high, short low and a "0" bit is a long low, short high. Of course, other message forms and bit encoding can be used while continuing to use the principles described herein as will be evident to those skilled in the art.

Figure 11:
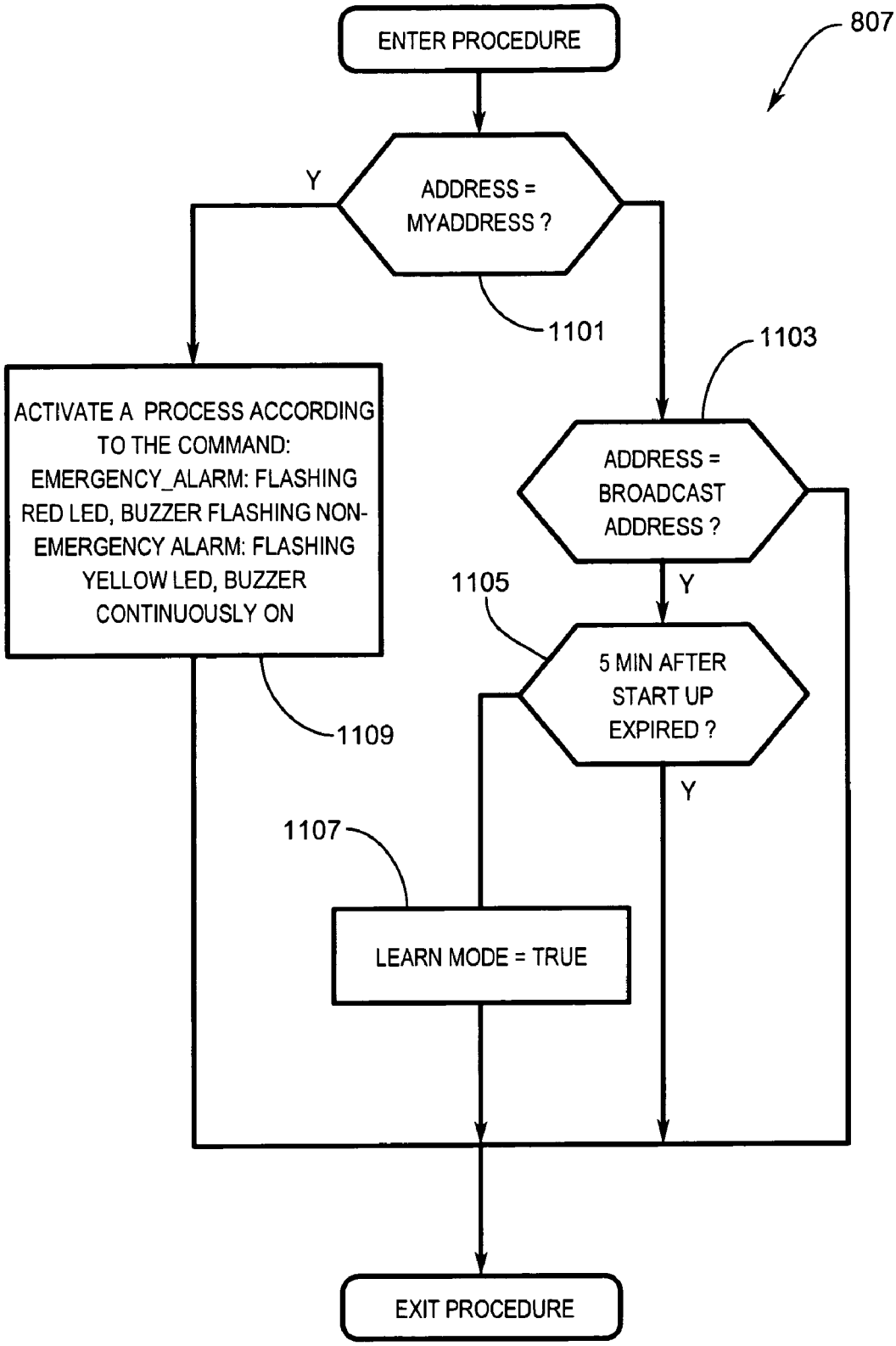
FIG. 11 is a flow diagram of a message interpretation routine used in the main module of FIG. 8.

Referring to FIG. 11, if a message has been received the module 802 then interprets the message using routine 807 to determine at 1101 if the address in the message is the address of the sign 1 (the sign has a ten bit address stored in its registers to differentiate between units). If it is not the address of the sign then it is determined at 1103 if it is a broadcast address meant for all signs (a common broadcast address is also stored in the sign registers). If it is a broad cast address the routine 807 checks at 1105 to see if a threshold amount of time has expired since the module 802 started, for example 5 minutes. If not then the routine sets Learn Mode as True at 1107. If 5 minutes has expired then the routine ends. If at 1101 the message address is the address of the sign then the command is checked at 1109 and the message interpretation routine 813 is commenced in accordance with the command.

Figure 12:
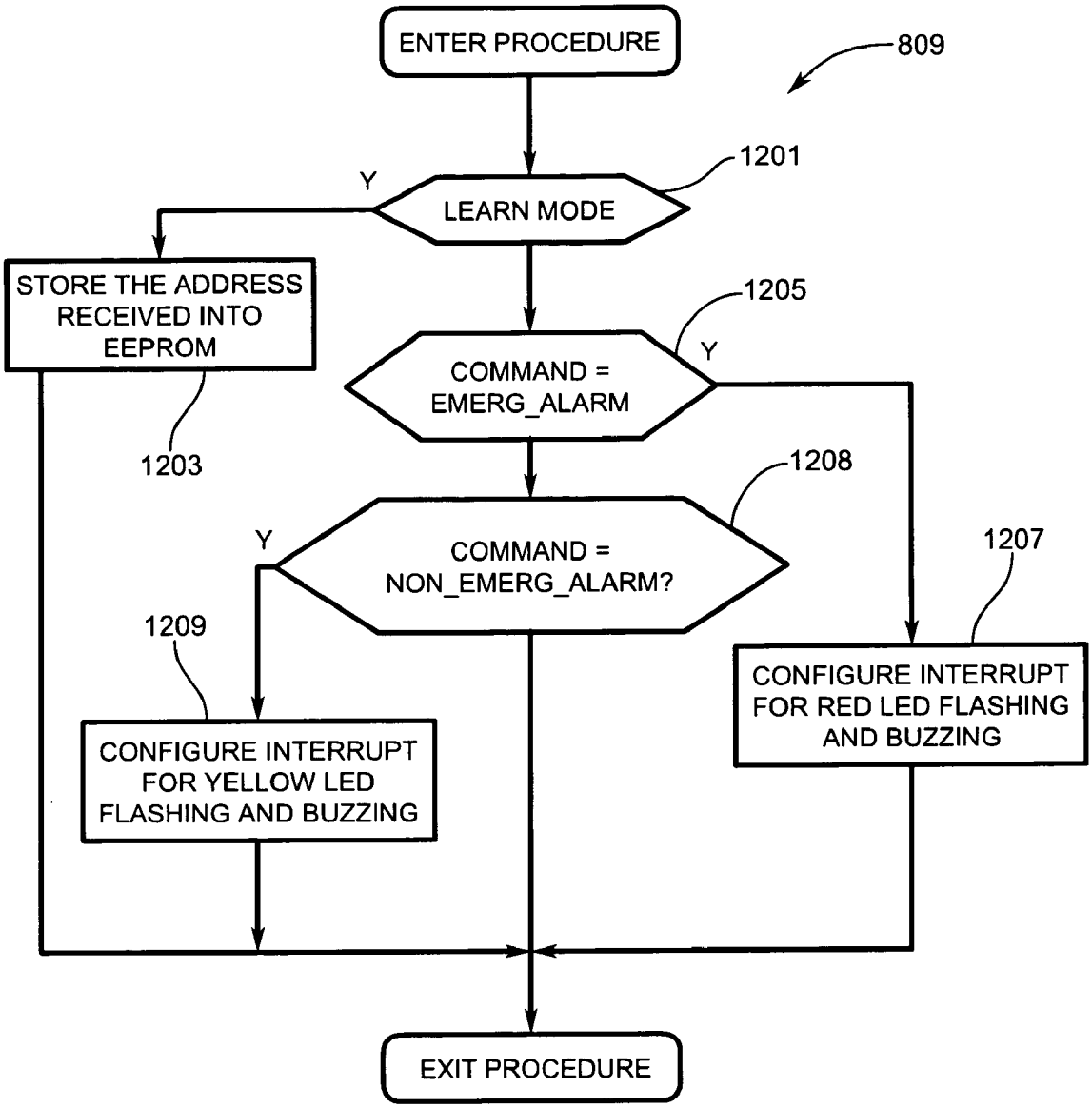
FIG. 12 is a flow diagram of a task scheduler routine used in the main module of FIG. 8.

Referring to FIG. 12, the task scheduler 809 follows message interpretation 807. If Learn Mode is True at 1201 then a message will contain the address of the sign 1 to be stored in nonvolatile memory, such as an EEPROM (electrically erasable programmable read only memory) located in the controller 701, at 1203. It is to be noted that storage could be provided separate from the controller 701, as will be evident to those skilled in the art. This allows the sign 1 to learn the address of a remote transmitter to be described. If Learn Mode is not True then if the command is an Emergency Alarm at 1205 the interrupt service routine is configured at 1207 for visual and audible emergency alarm indicators, such as light sources 21*b* (RED) flashing and buzzer 707 intermittently buzzing. If the command is a non-emergency alarm at 1208 then the interrupt service routine is configured at 1209 for visual and audible non-emergency alarm indicators, such as light source 21*a* (YELLOW) flashing and buzzer 707 continuously buzzing.

Figure 13:
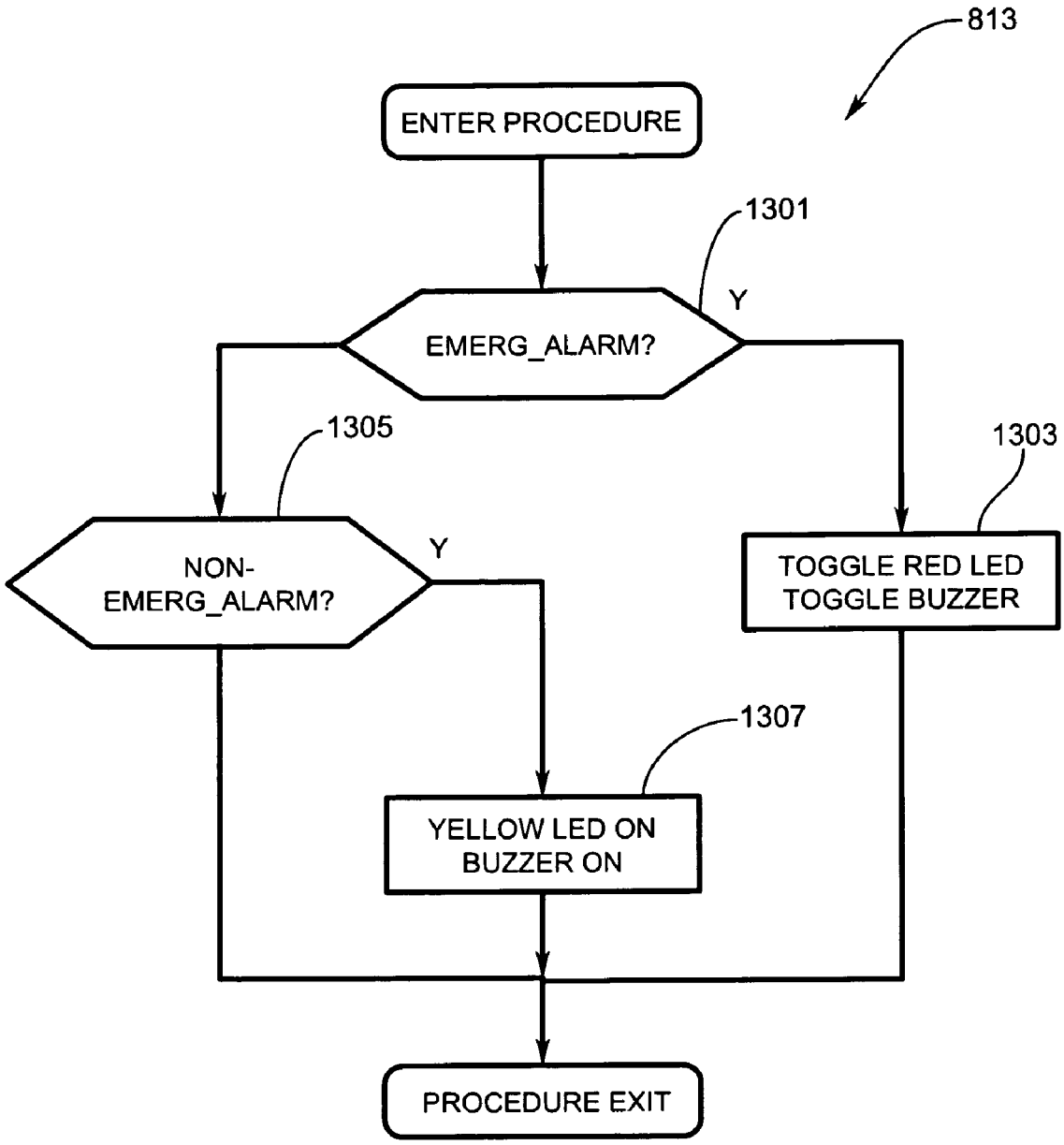
FIG. 13 is a flow diagram of receiver interrupt service routine of FIG. 8.

Referring to FIG. 13, the interrupt service handling routine 813 starts running when commanded to do so by the message interpretation routine 805 through the task scheduler 809. It looks to see if the current stored command is an emergency alarm at 1301 and, if so, it toggle activates at 1303 the light sources 21*b* (RED, using the switch Q1B) and the buzzer 707. In the preferred embodiment the toggle period is 500 msec. If the command is not an emergency alarm, it looks to see if the stored command is a non-emergency alarm at 1305. If so, it continuously activates at 1307 the light sources 21*a* (YELLOW, using the switch Q1A) and the buzzer 707. If there is no emergency alarm command or non-emergency alarm command then the interrupt service routine simply ends. The routine 813 uses data generated by the task scheduler 809 to ensure that correct indication is provided by the sign to indicate the Alarm status.

Figure 14:
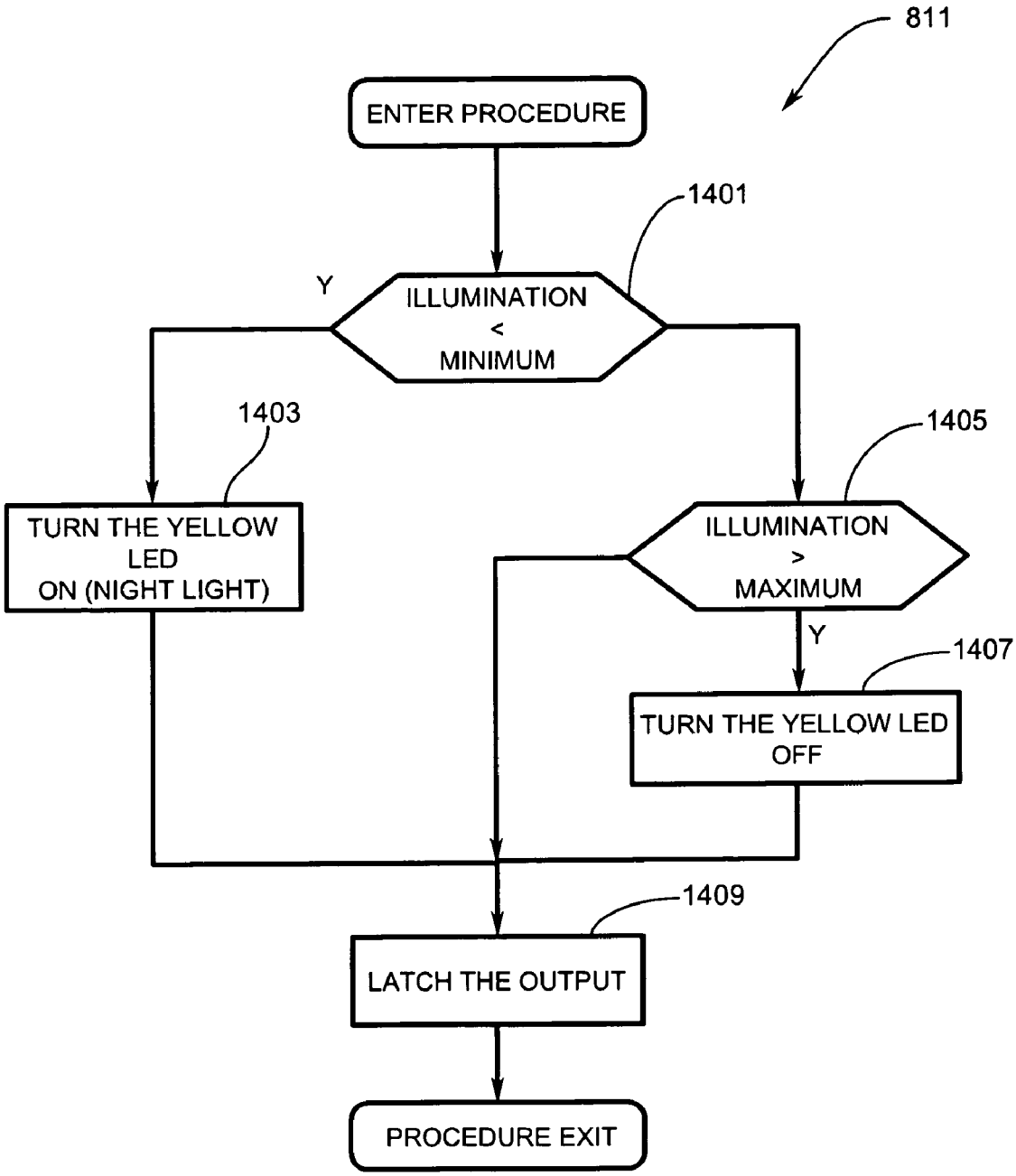
FIG. 14 is a flow diagram of a receiver output driving routine used in the main module of FIG. 8.

Referring to FIGS. 14 and 7, the light sensor 703 contains a photoresistor CR1 that decreases in resistance when illuminated, and increases in resistance when not illuminated. Decreasing resistance raises the voltage across resistor R1, while increasing resistance lowers the voltage across resistor R1. These conditions are sensed by the controller 701. If illumination is less than a minimum amount (for example, at night) at 1401, the controller 701 at 1403 turns the lights sources 21*a* (YELLOW) on by closing the switch Q1A. This allows current to flow through the light sources 21*a*. If at 1405 the sensor 703 is sufficiently illuminated, the controller 701 opens the switch Q1A. This prevents current from flowing through the power supply board 23*b* to the light boards 23*a* and turns off the light sources 21*a* at 1407. If at 1405 the illumination is neither below the minimum or above the maximum, then the state of the light sources 21*a* is not changed. The use of minimum and maximum light levels is used to provide hysterisis between the on and off states of the light sources. This prevents the light sources from flickering on and off when the light level is at the switching point. In any event the output to the switch Q1A is latched at 1409.

Figure 15:
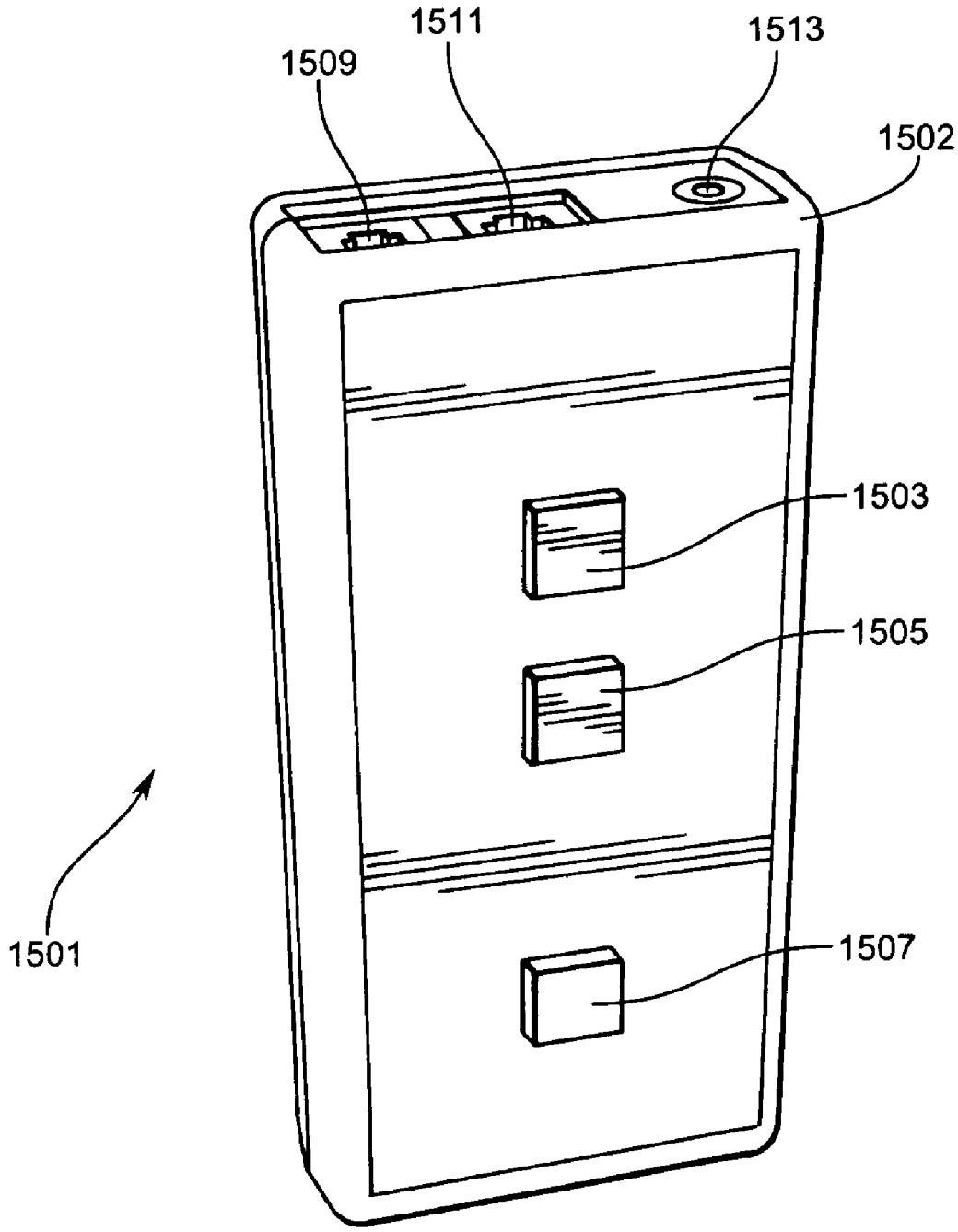
FIG. 15 is a perspective view of a transmitter unit in accordance with a preferred embodiment of an aspect of the present invention for use in association with the sign of FIG. 1.

Referring to FIG. 15, an example transmitter 1501 for use with the sign 1 has a cover 1502 and three external buttons: Program 1503, Reset 1505 and Emergency 1507. The buttons provide a means for user input to the transmitter unit 1501. User input is also possible in the preferred embodiment using a telephone, not shown, to enter digits from the telephone keypad when the telephone is off-hook. As will be evident to those skilled in the art, many other forms of user input could be provided to enable the features and functions described herein.

The transmitter 1501 also has two telephone connectors 1509, 1511, for example RJ11 telephone connectors, and a power jack 1513. The transmitter 1501 may have a battery backup power source, not shown, in case of main power failure. The transmitter 1501 has two modes Program and Running. The transmitter can transmit using a specific wireless communication address or a broadcast address. The transmitter 1501 transmits message in the formats previous described for the sign 1. In Program mode the transmitter 1501 can send a broadcast message with a wireless communication specific address. The transmitter 1501 is prompted to enter learn mode by holding the Program button for a period of greater than 5 seconds. The sign can use this message to Learn and store the address that the transmitter 1501 will use to address messages intended for the sign 1. In Program mode the transmitter 1501 can also learn up to three telephone numbers for dial detection on the telephone line. This is in addition to the standard 911 emergency telephone number. Of course, capacity for additional telephone numbers can be easily added to the systems. Capacity for three telephone numbers was chosen as it seems to be sufficient for most circumstances. In Running mode the transmitter 1501 monitors the telephone line for dialling of one of the emergency numbers. If it recognizes the dialling of an emergency number then it transmits a radio frequency Emergency alarm message to the sign 1. The transmitter 1501 also has an emergency button 1507 that can be physically pressed to begin transmission of an emergency alarm message. The transmitter 1501 continues radio frequency transmission of the emergency alarm message until a Reset button 1505 is pressed. This ceases transmission of the emergency alarm message and returns the sign 1 to its Running mode. The transmitter 1501 can also cease transmission of an emergency alarm message after a set period of time has passed. The transmitter 1501 may have other alarm inputs, some of which may be designated as non-emergency alarms that cause the transmission of a non-emergency alarm message.

Alternatively, the transmitter unit 1501 could transmit an emergency alarm to the sign 1 and the sign 1 can continue in one of its alarm modes until it receives a Reset message from the transmitter 1501.

Figure 16A:
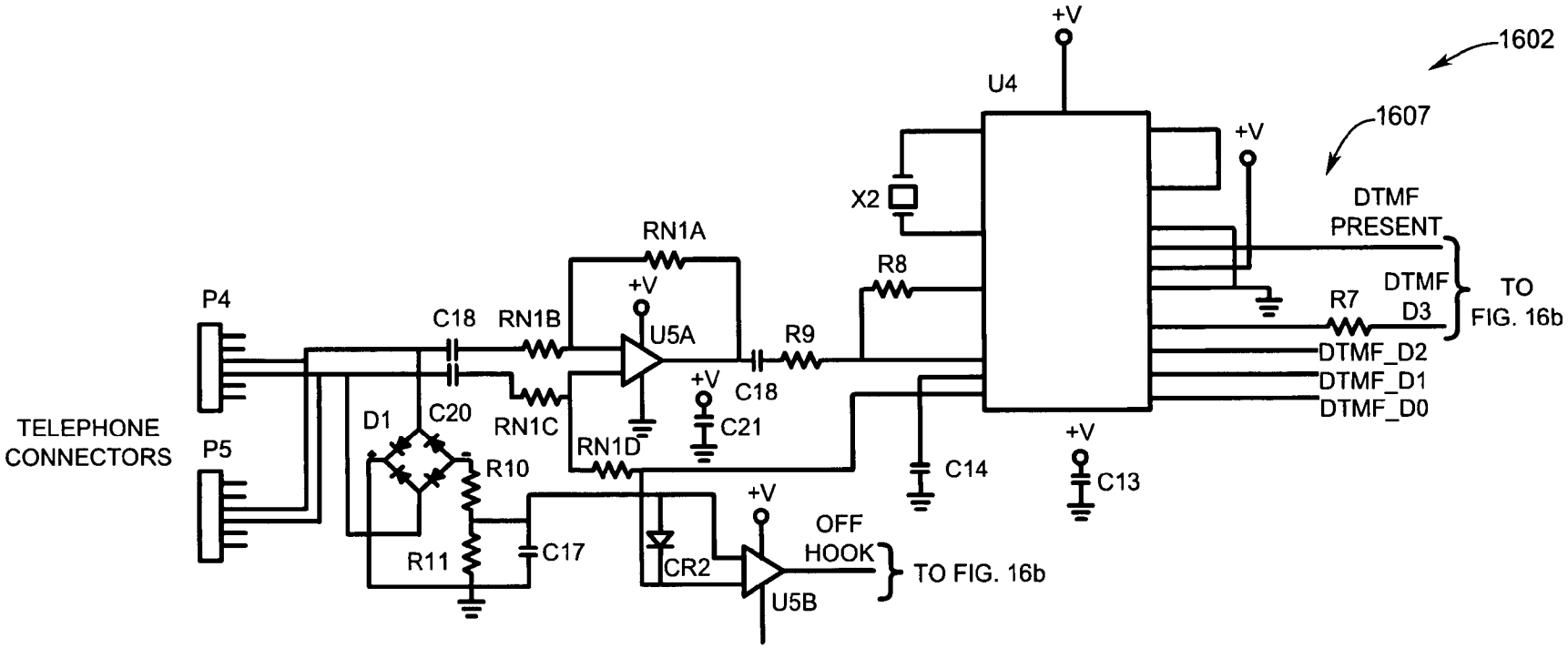
FIG. 16*a* is a schematic diagram of a telephone decoder circuit portion of transmitter unit circuit for use in the transmitter of FIG. 15.
Figure 16B:
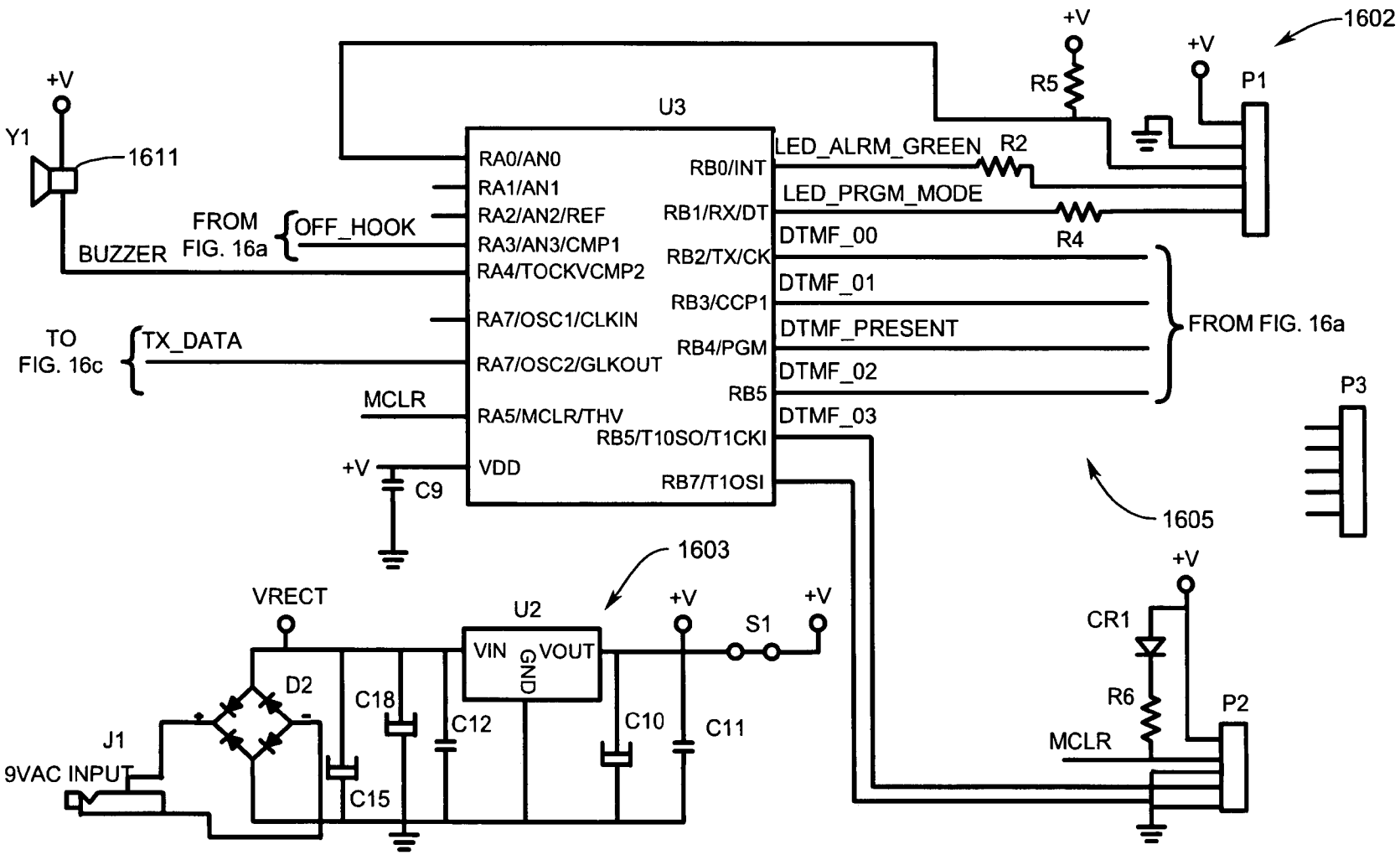
FIG. 16*b* is a schematic diagram of a control circuit portion and a power circuit portion of transmitter unit circuit for use in the transmitter of FIG. 15.
Figure 16C:
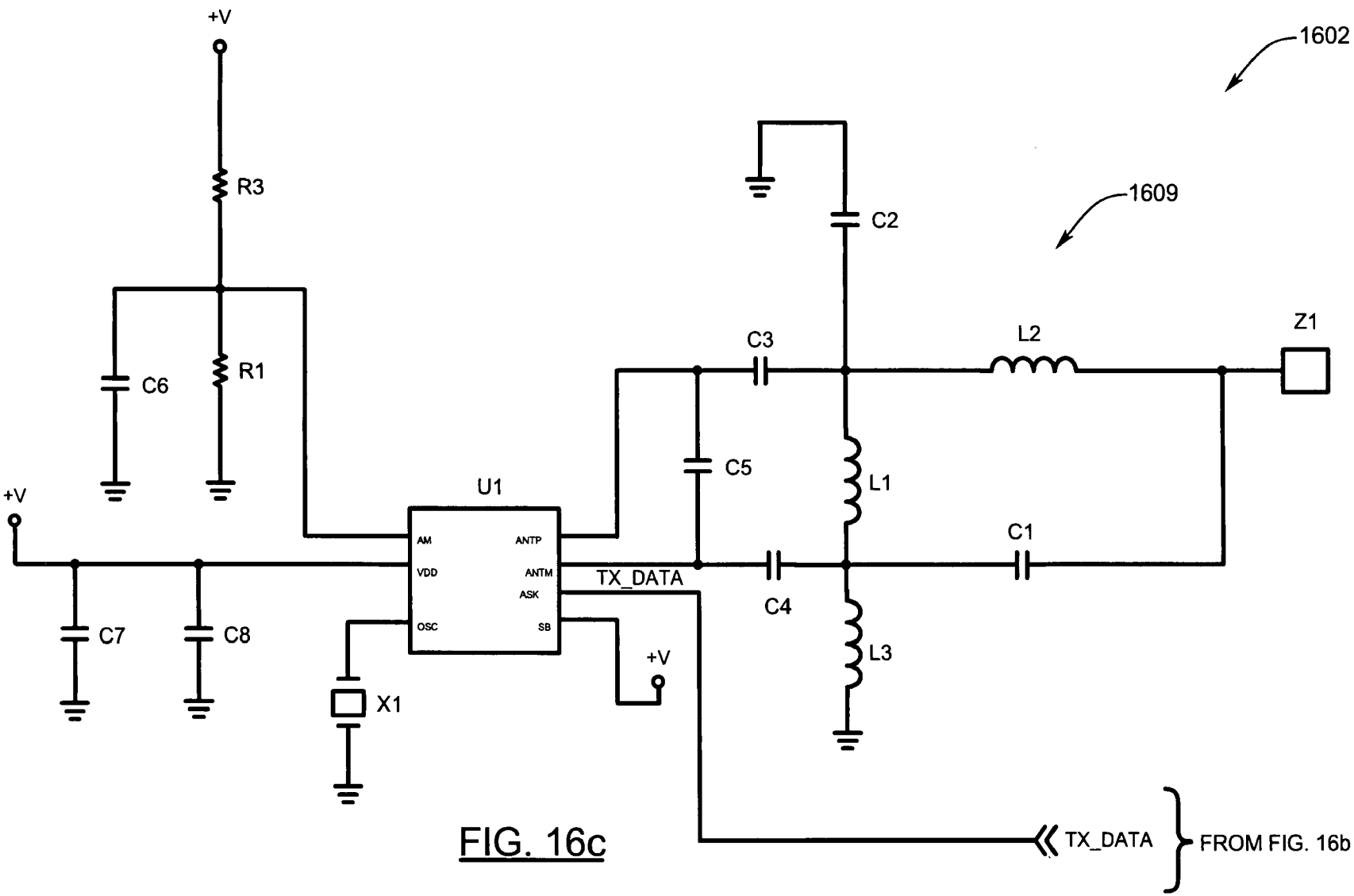
FIG. 16*c* is a schematic diagram of a transmitter circuit portion of a transmitter unit circuit for use in the transmitter of FIG. 15.

Referring to FIG. 16, the transmitter 1501 has a printed circuit board with a transmitter unit circuit 1602 having four circuit portions: power circuit 1603 receiving power at power jack 1513, control circuit 1605, phone decoder circuit 1607 for connection to a telephone line and to a telephone at connectors 1509, 1511, and radio frequency wireless transmitter circuit 1609. The transmitter 1501 directly connects the telephone connectors 1509, 1511 to allow connection between the telephone line and a telephone while the transmitter 1501 is connected.

The phone decoder 1607, in a known manner, detects an off-hook condition of the phone and decodes DTMF tones or dial pulses dialled at the phone. An off hook condition is indicated at DTMF_PRESENT by the decoder 1607, while decoded DTMF digits are provided in binary form at DTMF_D0-2. This information is passed to the control circuit 1605.

As the transmitter 1501 is connected through one of the connectors 1509 or 1511 to the telephone line, the transmitter unit also monitors off-hook and dialling on any other telephone connected in the same telephone circuit.

The circuits 1603, 1605, 1607, 1609 are interconnected by traces between pins having similar descriptors, for example, DTMF_PRESENT in circuits 1605, 1607 are connected to one another and TX_DATA in circuits 1605, 1609 are connected to one another.

The control circuit 1605 is built around a controller 1610, such as PIC16F628 microcontroller, which contains a program (some details of which are to be described further below) to control the operation of the transmitter 1501 to provide the features and functions described herein. The control circuit 1605 sends transmission data (TX_DATA) to the wireless transmitter circuit 1609 for transmission via an antenna connected at Z1. The control circuit 1605 also has, and controls, a buzzer 1611. The power circuit 1603 receives power at power jack 1513, typically 9 VAC from a wall power adapter, not shown, and converts it to usable power for the components in the transmitter 1501, typically 5 VDC.

The decoder 1607 and control circuit 1605 act in combination as an alarm detector by detecting dialling of emergency telephone numbers at a telephone, not shown, after the telephone goes off-hook.

Figure 17:
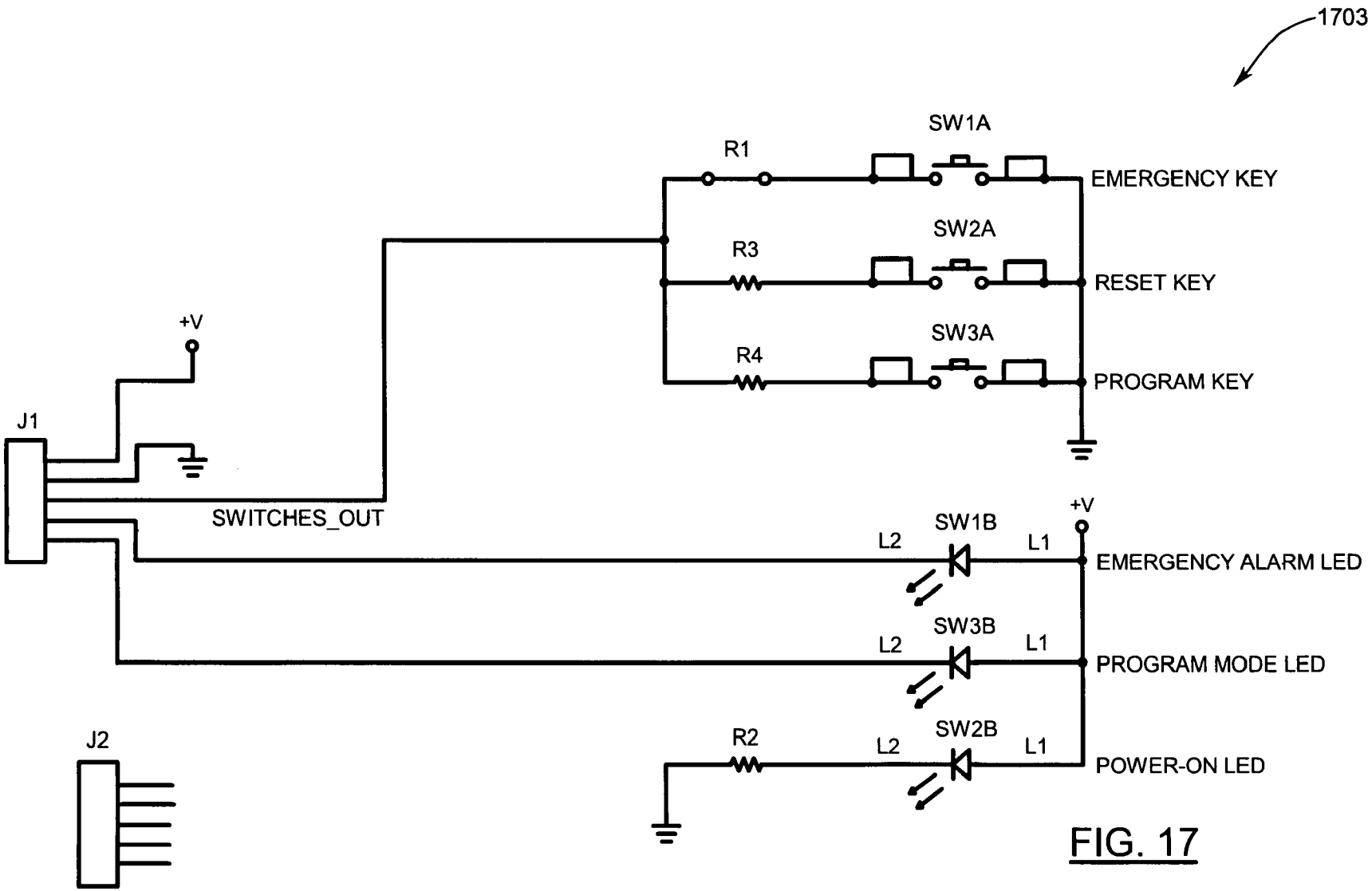
FIG. 17 is a schematic diagram of a switch circuit for use in the transmitter of FIG. 15.

Referring to FIG. 17, the transmitter 1501 also contains a second printed circuit board that has a switch circuit 1703. The switch board 1701 stands on top of the board 1601 and is connected at either end by tall jumper connectors J1, J2 to jumpers P1 and P3 (FIG. 6). This places button switches SW1A, SW2A, SW3A (externally accessible as buttons 1507, 1505, 1503) in correct relationship with the transmitter cover 1502. A button press 1507, 1505 or 1503 is individually received and differentiated by the control circuit 1605. The switch circuit 1701 has individual LEDs SW1B, SW2B, SW3B to indicate the mode of the transmitter 1501. These LEDs SW1B, SW3B illuminate their respective buttons 1507, 1503 when activated. LEDs SW2B can be set in a separate opening, not shown, in cover 1502.

Figure 18:
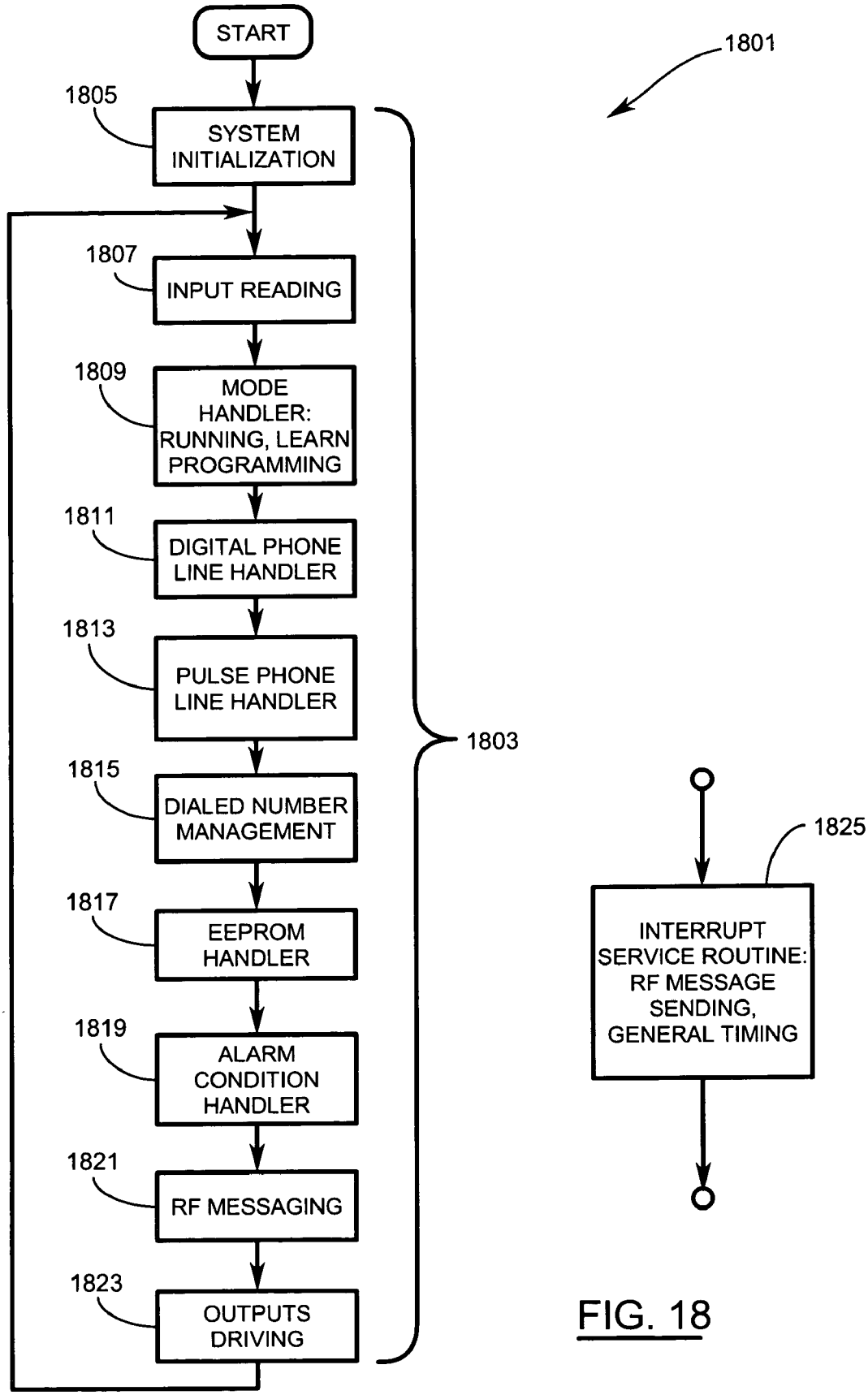
FIG. 18 is a flow diagram of a main module and interrupt service routine of the transmitter of FIG. 15.

Referring to FIG. 18, the controller 1610 contains a program 1801 having a main module 1803 with ten routines: system initialization 1805, input reading 1807, mode handling 1809, digital phone line handler 1811, pulse phone line handler 1813, dialled number management 1815, EEPROM handler 1817, alarm condition handler 1819, RF messaging 1821, output driving 1823.

The program also has an interrupt service routine 1825. System initialization 1805 is performed when the unit 1501 first receives power at the jack 1513. After that the program 1801 loops through the other routines in the main module 1803 in order, unless it is handling an interrupt via the interrupt handler routine 1825.

Figure 19:
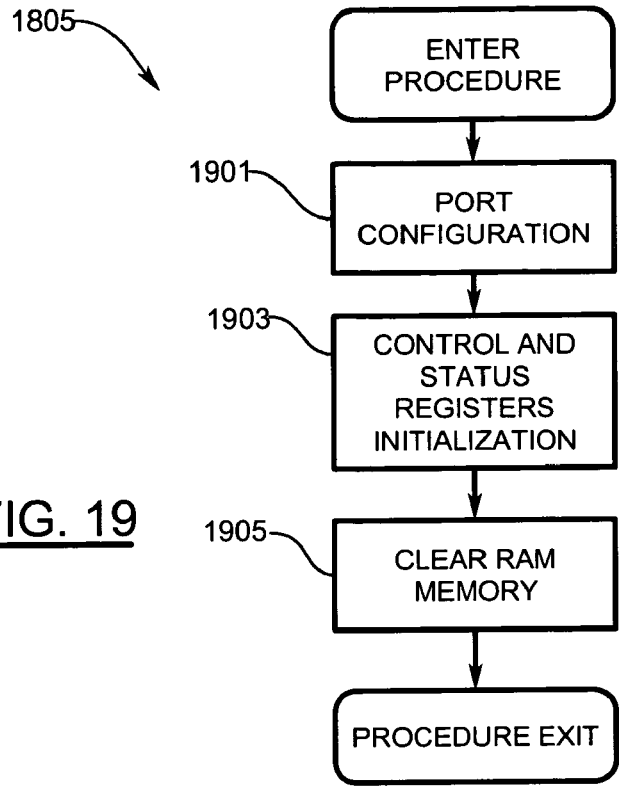
FIG. 19 is a flow diagram of a system initialization routine of the main module of FIG. 18.

Referring to FIG. 19, system initialization 1805 comprises port configuration 1901, control and status register initialization 1903, and clearing RAM memory 1905.

Figure 20:
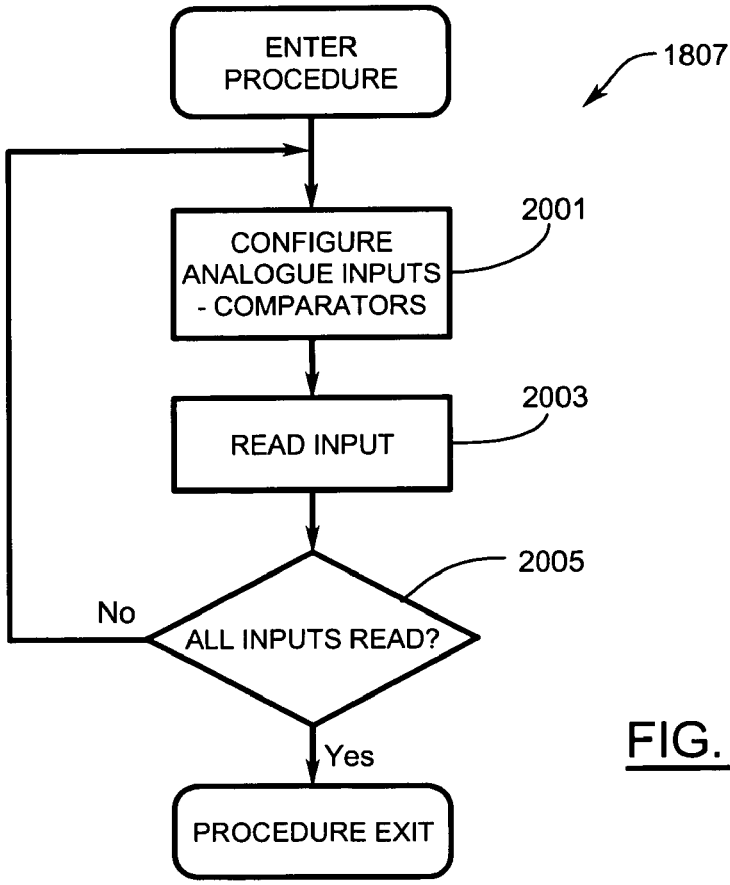
FIG. 20 is a flow diagram of a read inputs routine of the main module of FIG. 18.

Referring to FIG. 20, input reading 1807 reads and debounces all of the relevant inputs (switches SW1A, SW2A, SW3A). It first configures analogue inputs—comparators 2001. As all analogue inputs generate different analogue voltage on an input, comparators with variable thresholds must be used for reading analogue inputs. An input is then read 2003. If there is another input to be read then the above steps are repeated at 2005, otherwise, the routine ends.

Figure 21:
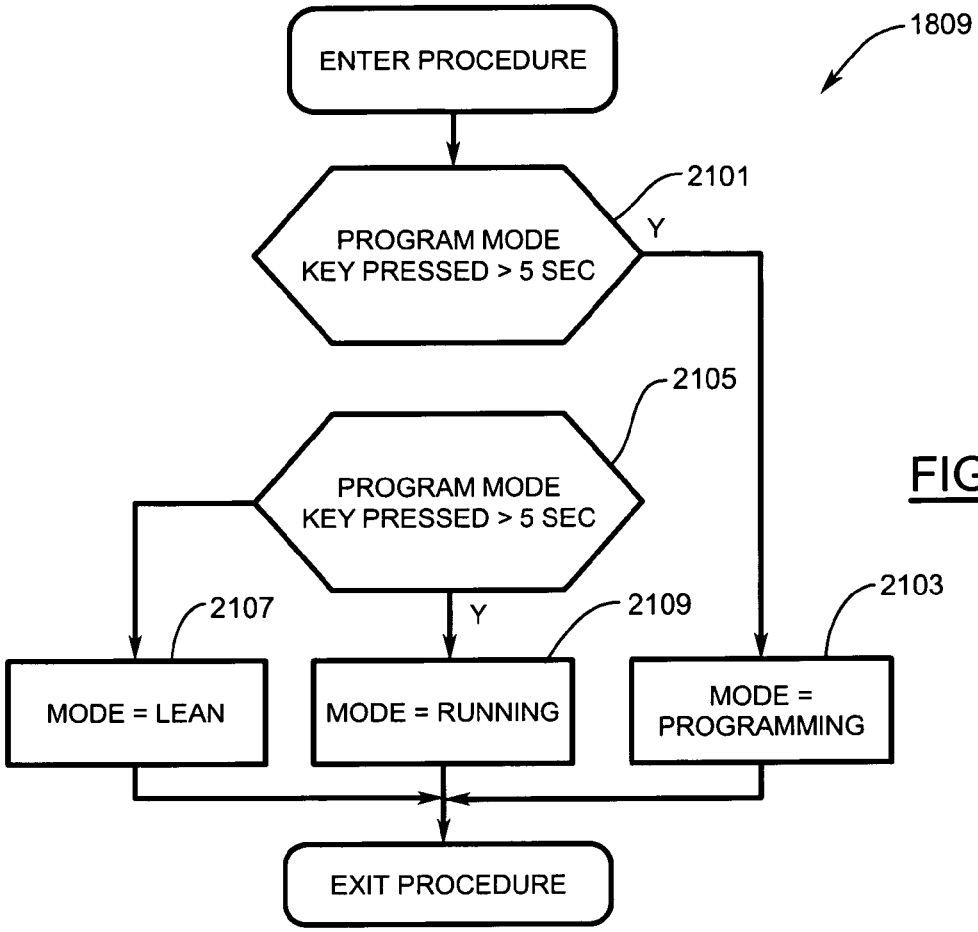
FIG. 21 is a flow diagram of a mode handler routine of the main module of FIG. 18.

Referring to FIG. 21, mode handler 1809 checks at 2101 to see the program button 1503 was pressed for more than 5 seconds. If so, Mode is set to Programming at 2103. If not, then it checks 2105 to see if the program button was pressed for less than 5 seconds. If so, the Mode is set to Learn at 2107. If not, the Mode is set to Running at 2109.

Figure 22:
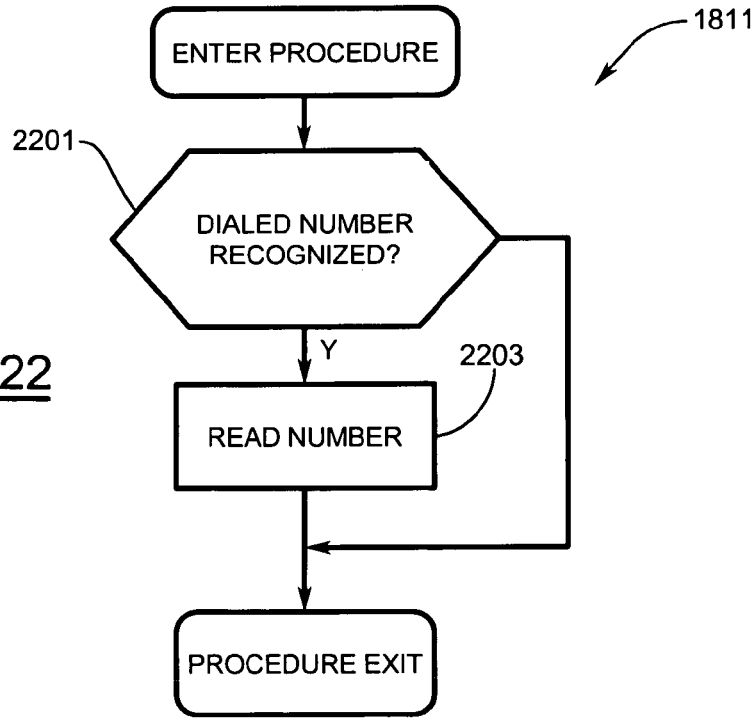
FIG. 22 is a flow diagram of a digital phone line handler routine of the main module of FIG. 18.

Referring to FIG. 22, digital phone line handler 1811 checks at 2201 to see if a dialled number has been recognized by the phone decoder 1607. If so, it reads the number at 2203. If not, the routine simply ends.

Figure 23:
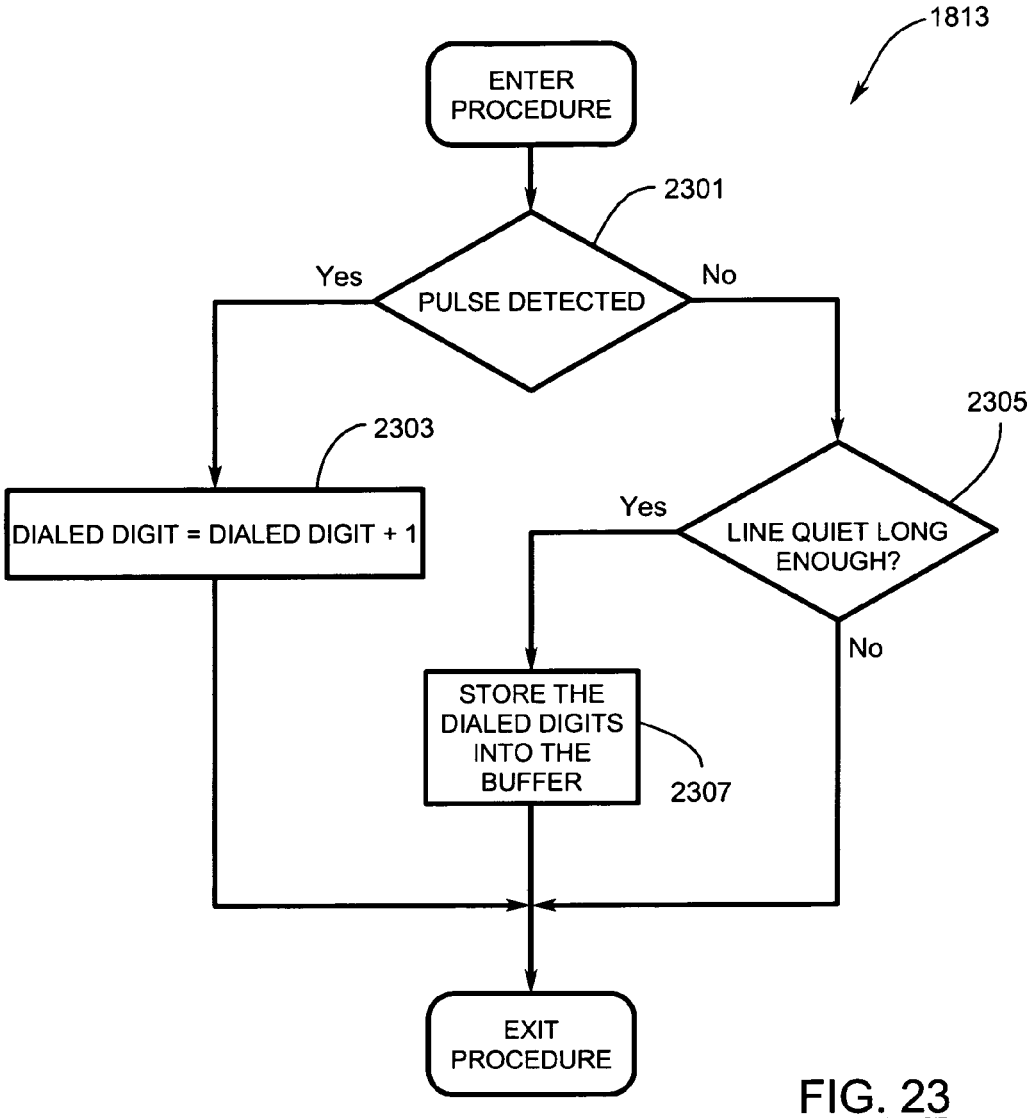
FIG. 23 is a flow diagram of a pulse phone line handler routine of the main module of FIG. 18.

Referring to FIG. 23, pulse phone line handler 1813 checks at 2301 to see if a pulse has been detected by the decoder 1607. If so, the dialled digit is incremented by one at 2303. If a pulse is not detected then the handler 1813 checks at 2305 to see if the time since the last pulse has passed a given threshold. If so, then the dialled digit is stored at 2307. If not, the routine simply ends.

Figure 24:
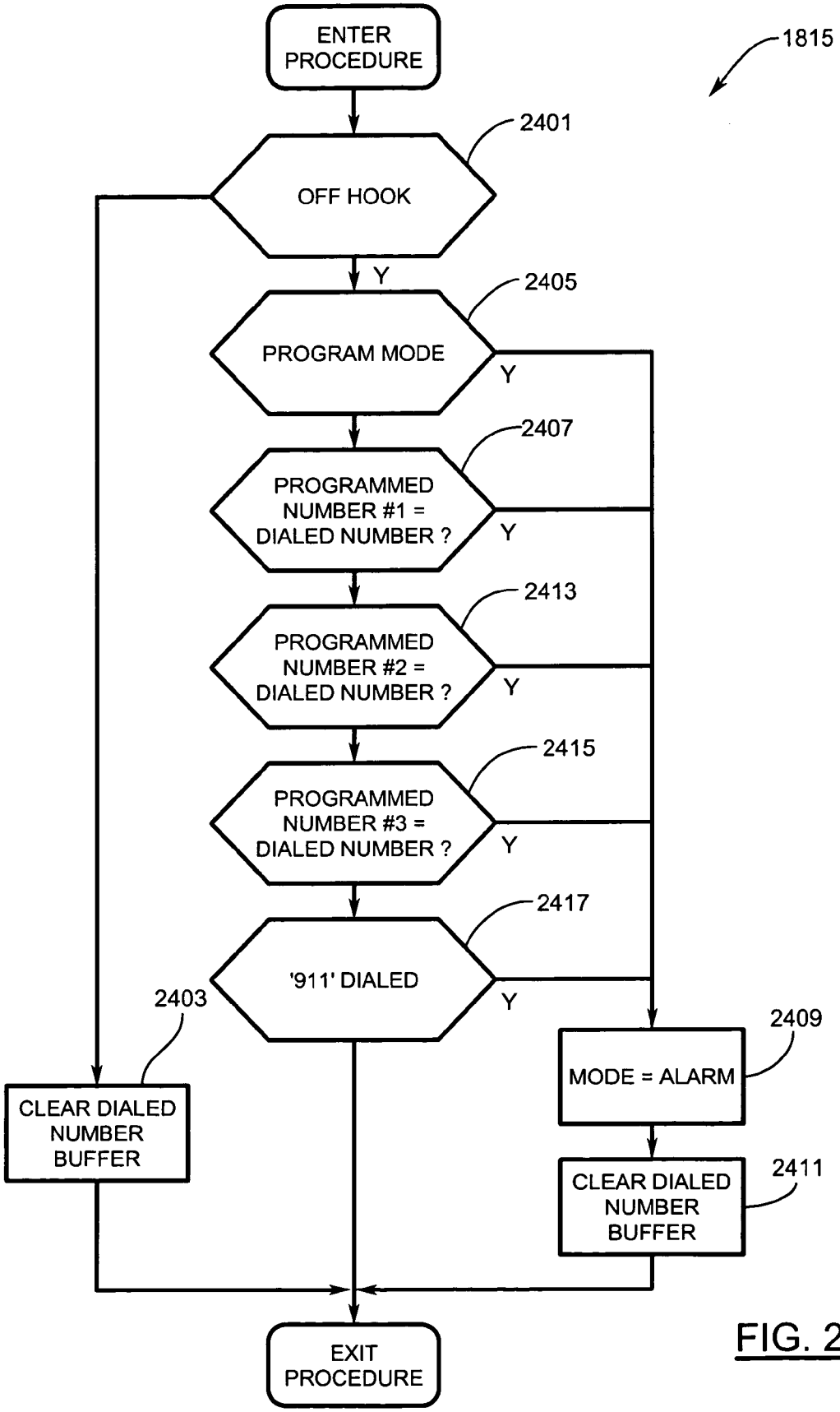
FIG. 24 is a flow diagram of a dialled number management routine of the main module of FIG. 18.

Referring to FIG. 24, dialled number management 1815 checks to see if the dialled numbers (sequence of dialled digits) match a certain sequence and, if so, sets Mode to Alarm. The routine checks at 2401 to see if the phone is off hook. If not, it clears the dialled number buffer at 2403 and exits. If so, the routine checks at 2405 to see if Mode is Program. If so, the routine exits as an alarm is not sounded when a number is being programmed. If not, the routine checks at 2407 to see if the number dialled is equal to a first programmed (stored) number. If so, Mode is set to alarm at 2409 and the dialled number buffer is cleared at 2411 and the routine exits. If not, the process is repeated at 2413 with a second programmed number, and 2415 with a third programmed number, and at 2417 with the standard emergency number "911". More or less programmed numbers could be implemented to be used, for example, for the local fire emergency number, ambulance number, or hospital emergency department.

Figure 25:
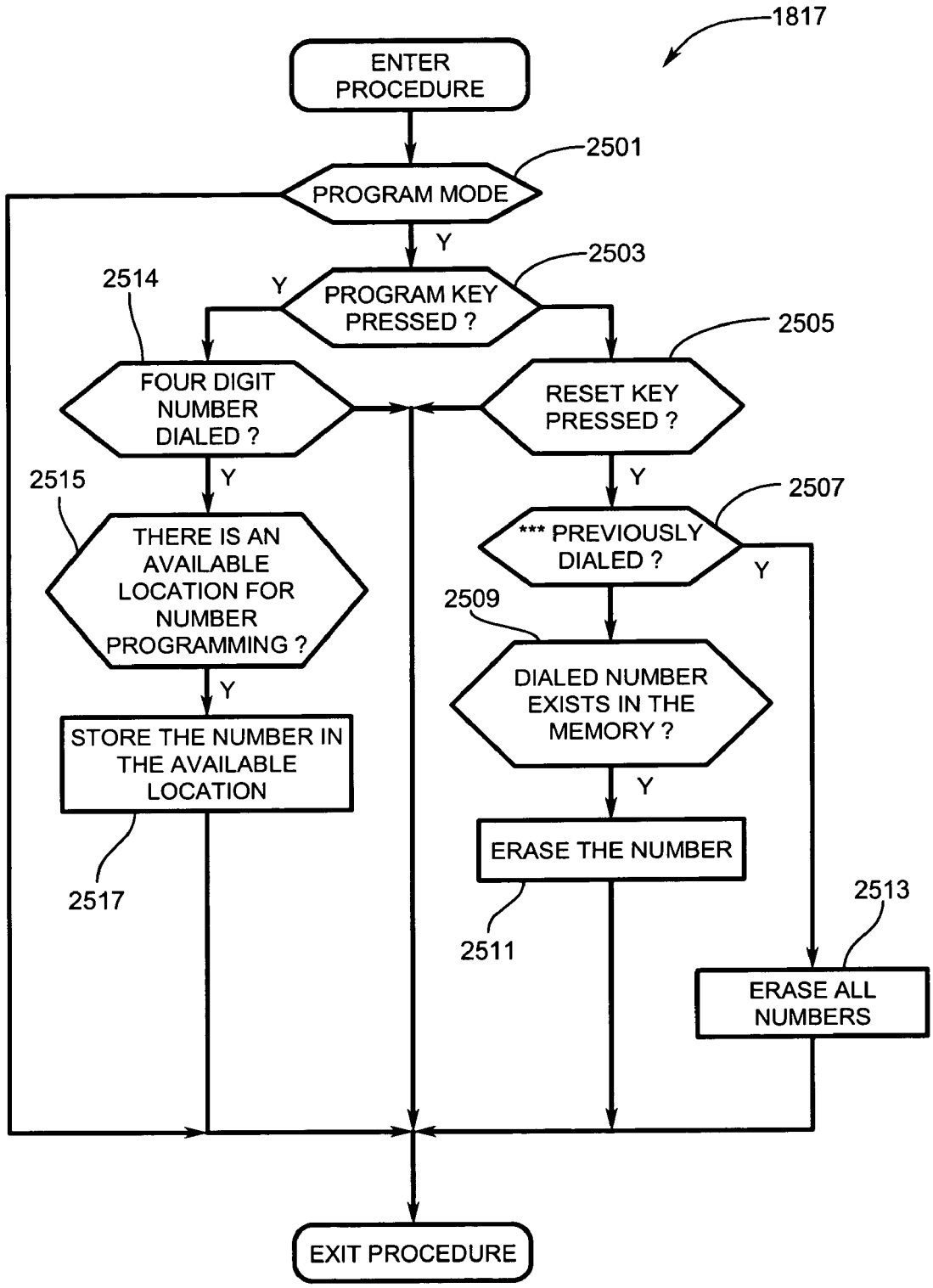
FIG. 25 is a flow diagram of an EEPROM handler routine of the main module of FIG. 18.

Referring to FIG. 25, EEPROM handler 1817 checks at 2501 to see if Mode is Program. If so, it checks 2503 to see if the Program Key 1503 has been pressed. If not, it checks at 2505 to see if the Reset Key 1505 has been pressed. If not, it exits. If so, it checks at 2507 to see if a reset code, for example, "*" has been dialled. If not, it checks at 2509 to see if a dialled number exists in memory. If so, the number is erased at 2511 and the routine exits. If not, the routine exits. If at 2507 the reset code was entered then all programmed numbers in memory are erased at 2513. If at 2503 the Program Key was pressed then the routine checks at 2514 to see if a 4-digit number was dialled. If not, the number is assumed to be in error and the routine exits. If so, the routine checks at 2515 to see if there is an available location for number programming (the preferred embodiment only allows three programmed numbers). If so, the number is stored at 2517**. If not, the routine exits.

Figure 26:
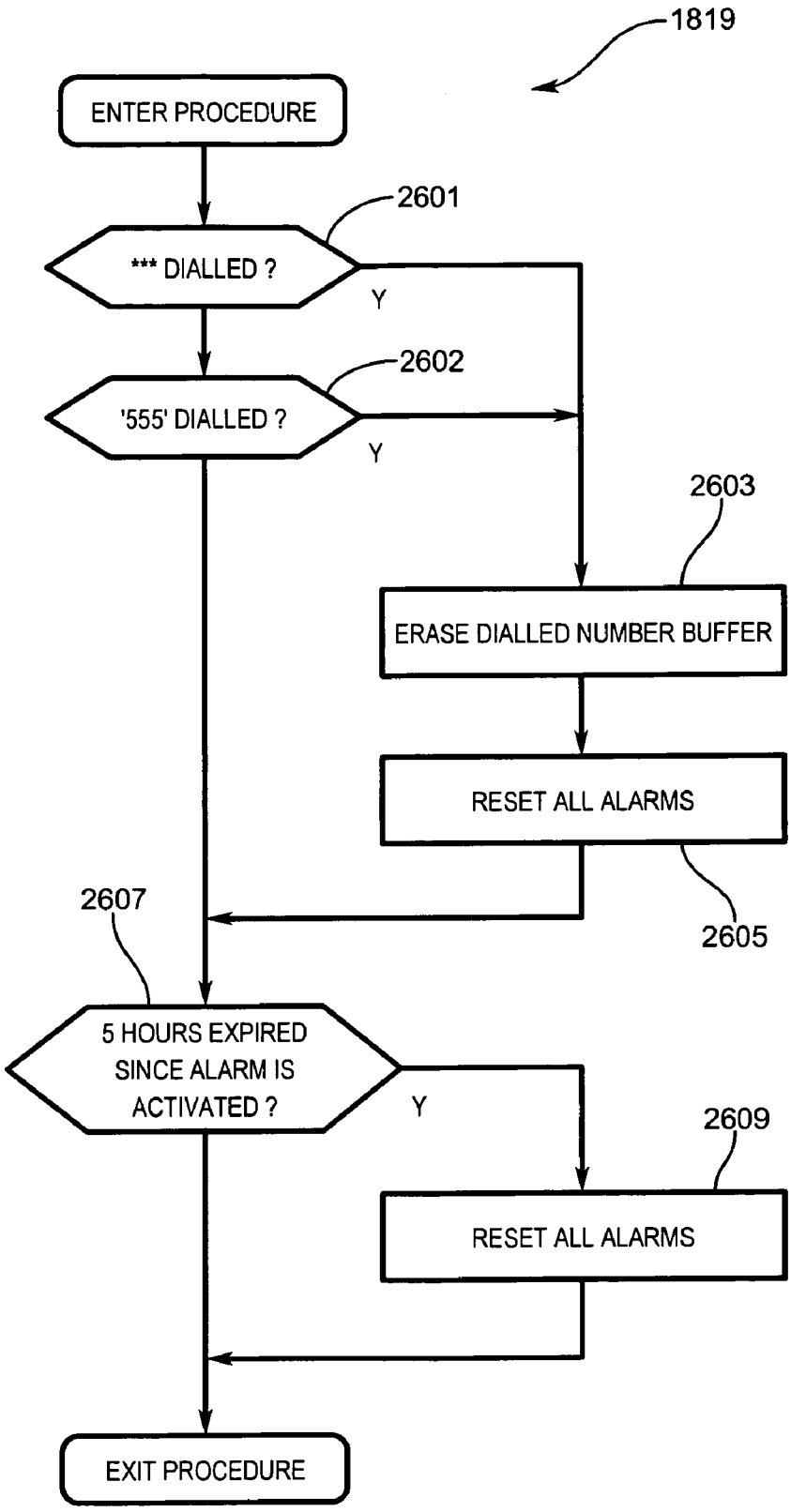
FIG. 26 is a flow diagram of an alarm condition handler routine of the main module of FIG. 18.

Referring to FIG. 26, alarm condition handler 1819 checks at 2601 to see if a non-numerical reset alarm sequence, such as "*" has been dialled. If not, the routine checks at 2602 to see if a numerical reset alarm sequence, such as "555" was dialled. "555" is used at least in Canada and the United States for pulse dialling systems as there is no telephone number that begins with "555". If either reset alarm sequence is dialled, the dialled number in the buffer is erased at 2603 and all alarms are reset at 2605. The handler 1819 then checks at 2607 to see if it has been 5 hours since an alarm was activated. If so, all alarms are again reset at 2609** and the routine exits.

If at 2602 a reset alarm sequence was not dialled, the routine continues from 2607 as described above.

Figure 27:
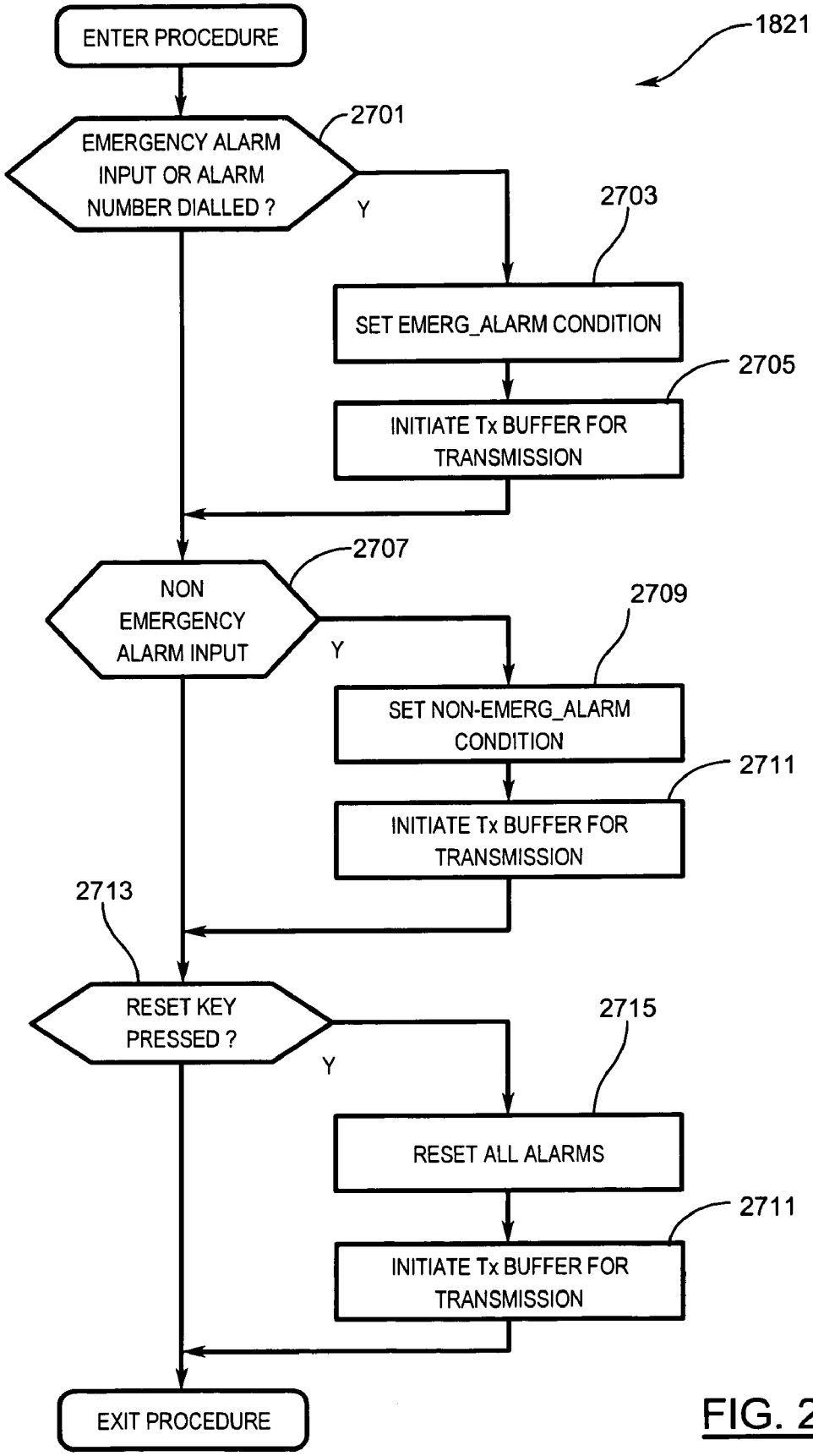
FIG. 27 is a flow diagram of an RF messaging routine of the main module of FIG. 18.

Referring to FIG. 27, RF messaging 1821 checks at 2701 to see if an emergency alarm input has occurred. These inputs can be from dialing an emergency number, activation of a smoke alarm, a signal from a security system or any other alarm condition. In the preferred embodiment, all alarm inputs are treated the same. If so, an emergency alarm condition is set at 2703 and the transmit buffer (Tx) is initiated (i.e. the correct message is stored into the buffer for transmission) for transmission at 2705 to the transmitter circuit 1609. The transmitter circuit 1609 independently transmits the data through the antenna connected at Z1 (FIG. 16). The routine then checks at 2707 to see if there is a non-emergency alarm input. (It is to be noted that the programs described herein contain some redundancies. For example, if it is determined that the alarm is an emergency alarm, there may be no need to check if the alarm is a non-emergency alarm. This redundancy causes no harm and it may be easier to implement programmatically.

However, it is to be noted that redundancy is a design choice and is not required.) If there is a non-emergency input, a non-emergency alarm condition is set at 2709 and the transmit buffer (Tx) is initiated for transmission at 2711 to the transmitter circuit 1609. The routine then checks at 2713 to see if the Reset Key 1505 was pressed. If so, all alarms are reset by sending a message to switch from Alarm mode to Running mode at 2715 and the transmit buffer (Tx) is initiated for transmission at 2711 to the transmitter circuit 1609. The routine then exits. If the Reset Key 1505 was not pressed then the routine simply exits.

Figures 28, 29:
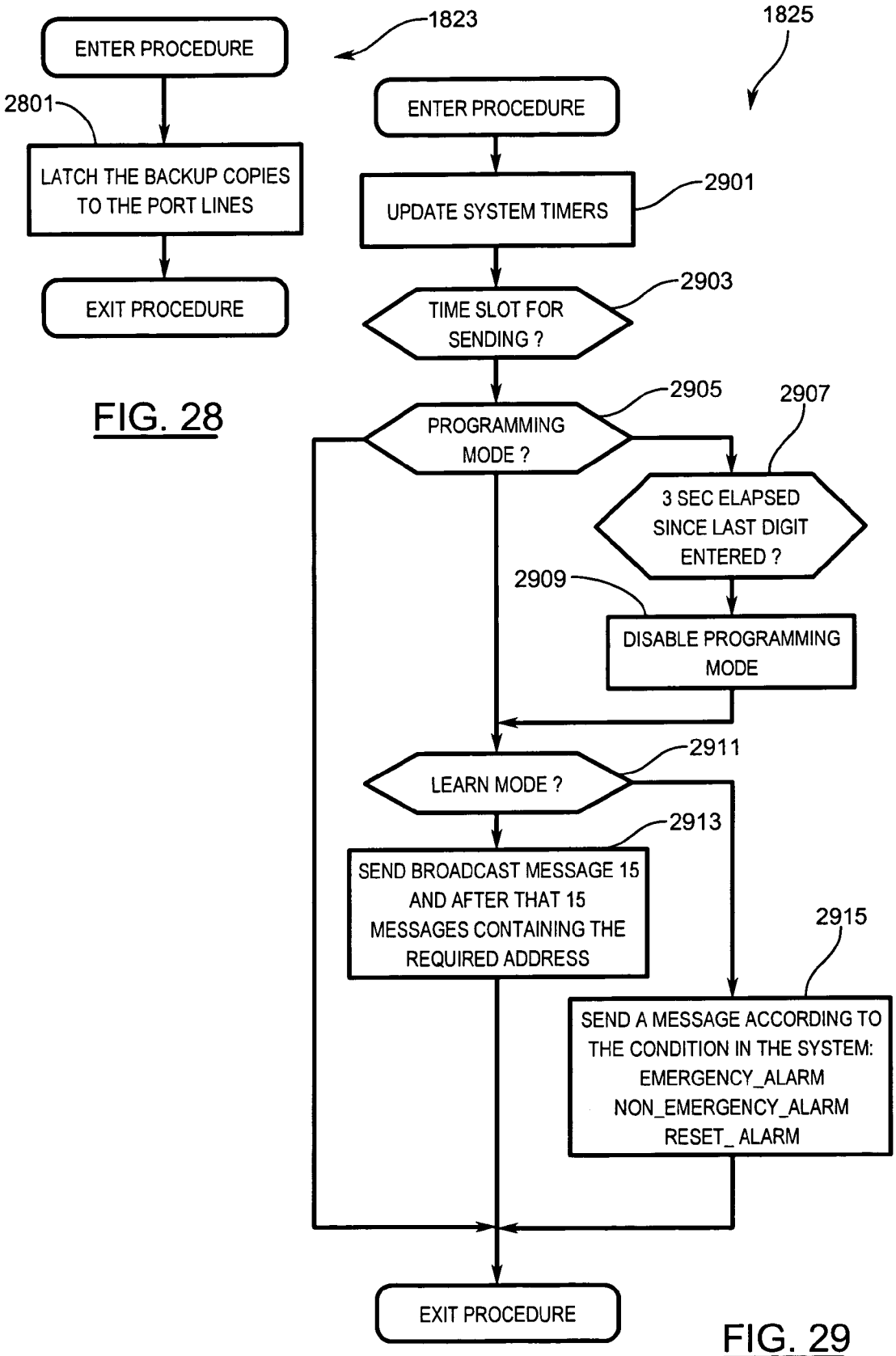
FIG. 28 is a flow diagram of an outputs driving routine of the main module of FIG. 18.
FIG. 29 is a flow diagram of the interrupt service routine of FIG. 18.

Referring to FIG. 28, output driving 1823 latches the backup copies (redundant data for system recover) to the port lines at 2801 and then exits.

Referring to FIG. 29, interrupt service routine 1825 is activated on a regular time basis, for example every 5 msec. This is used as a timekeeper in the system. Internal counters are updated by this routine to keep track of time with the number in the counter representing the number of 5 msec periods which have passed since they were last reset. A particular counter value is referred to as a time slot. It then checks at 2903 to determine if the current time slot has been allocated for transmission. If this is a transmission time slot, an RF transmission is initiated if there is a message to be transmitted. The routine checks at 2905 to see if the unit is in Programming mode. If it is then, the routine checks at 2907 to see if a threshold time has passed, for example 3 seconds, and if so, Programming mode is disabled at 2909. If 3 seconds have not passed then the routine simply continues. The routine then checks at 2911 to see if the unit is in Learn mode. If it is then at 2913 a broadcast message is sent to the transmitter circuit 1609 15 times and after that a message with the address of the unit 15. This allows a receiving unit, such as the sign 1, to learn which transmitter 1601 to receive messages from. If the unit 1601 is not in Learn mode then the previously set condition of the system, in the preferred embodiment either Emergency Alarm, Non-Emergency Alarm or Reset Alarm, is sent at 2915 to the transmitter circuit 1609 for transmission.

Operation of the sign 1 and transmitter unit 1501 combination is simple.

To test the unit, the emergency button 1507 is pressed. The buzzer 1611 is activated and the light sources 21*b* will flash red with the buzzer 707 activated intermittently. To cancel the emergency condition, the reset button 1505 is pressed or "***" is entered from a telephone.

To program emergency telephone numbers a telephone handset is lifted (taking the telephone off-hook) and the program button 1503 is pressed. In the preferred embodiment alarm telephone numbers are from 4 to 24 digits long. The transmitter unit 1501 will enter Program mode and the program mode LED SW3B (FIG. 17) will turn on. Program mode can only be entered when there is no alarm condition present. An alarm telephone number is dialled at the telephone. If more than 24 digits are entered only the first 24 digits are accepted. Once the alarm telephone number has been entered, the program button 1503 is pressed again. This causes the program mode LED SW3B to flash once, indicating that the entered number has been successfully accepted. A maximum of three emergency numbers can be stored at a time. If more than three numbers are entered, the program mode LED SW3B will flash three times to indicate that the entered number has not been accepted.

To erase a previously entered emergency alarm number, the above steps are followed, but the reset button 1505 is pressed after the number is entered instead of the program button 1503. The program button will flash twice to indicate that the number has been successfully erased. If an attempt is made to erase a number that is not in the unit 1501 then the program mode LED SW3B will flash four times.

In operation the sign 1 is non-illuminated if sufficient light is striking the face of the sign 1 and thus the sensor 702. In low light conditions, for example at night, the lights 21*a* are activated to provide backlight to the characters 5 for better visibility. The characters of the preferred embodiment are visible up to 150 feet away at night. The unit 1501 senses when "911" or a programmed emergency number is dialled after a telephone handset is taken off-hook. If so, the unit 1501 behaves as if the emergency button 1507 is pressed (see description above).

Figure 30:
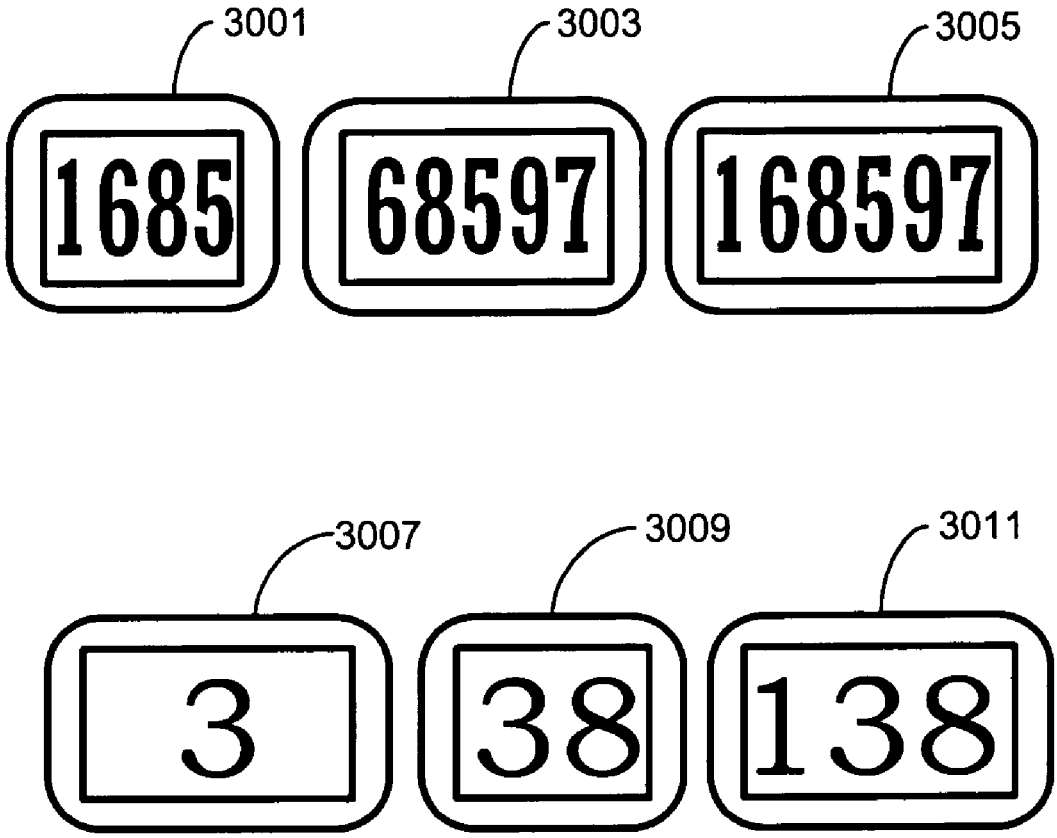
FIG. 30 is a plan of various alternate embodiments of the sign of FIG. 1.

Up to this point, the preferred embodiment has been described with respect to a sign 1 have two digits and two character plates. Referring to FIG. 30, it is evident that the sign 1 could be adapted to provide many digits to by increasing the number of diffusion chambers 17, associated light sources 21 and character plates 4 or alternatively, by providing more than one character 5 on a single character plate 4. Preferably, separate diffusion chamber 17 and associated light sources 21 would continue to be provided for each character 5 behind the background 22 between the characters 5; however, a single diffusion chamber 17 could be provided for a plurality of characters 5. The number and/or the capacity of the light sources 21 should be selected to provide adequate illumination to all of the characters 5. Signs can be used for different quantities of digits by providing blank (all opaque background 22 number plates 4), or by making custom number plates 4 that cover multiple diffusion chambers 17 with the characters 5 spaced accordingly. Examples of alternate sign configurations are shown as signs 3001, 3003, 3005, 3007, 3009, 3011.

In addition, multiple signs 1 can be used with one transmitter 1501. Alternatively, multiple transmitters 1501 can be used with one sign 1 or with multiple signs.

Figure 31:
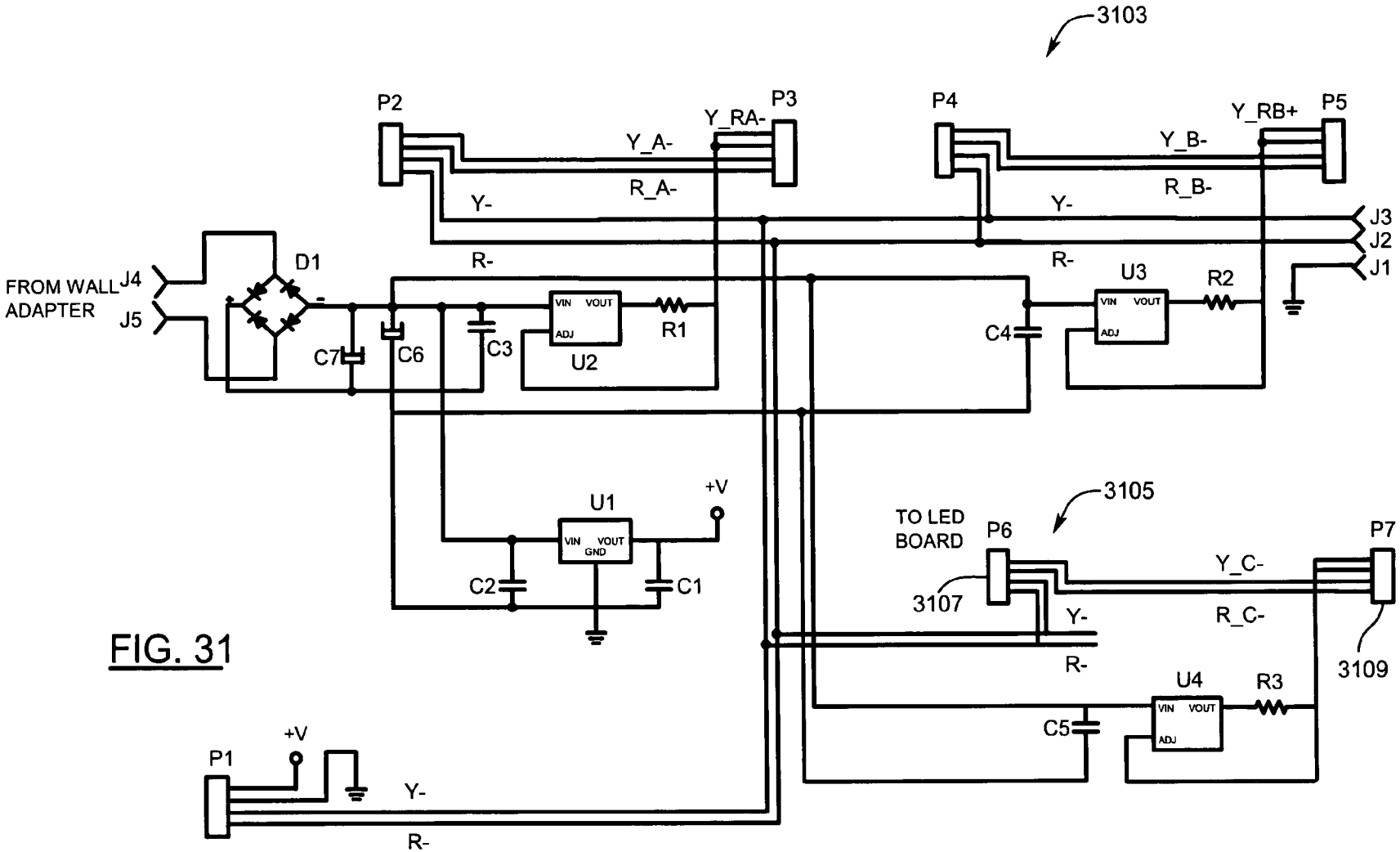
FIG. 31 is a schematic diagram of a power circuit for use in a three character plate alternate embodiment of the sign of FIG. 1.

Referring to FIG. 31, an example power circuit 3103 for a three digit sign 3011 (FIG. 30) is shown. The circuit 3103 operates in a similar manner to power circuit 400 (FIG. 4) with the addition of a third driving sub-circuit 3105 with connections 3107, 3109 to a third pair of light boards, not shown.

Figure 32:
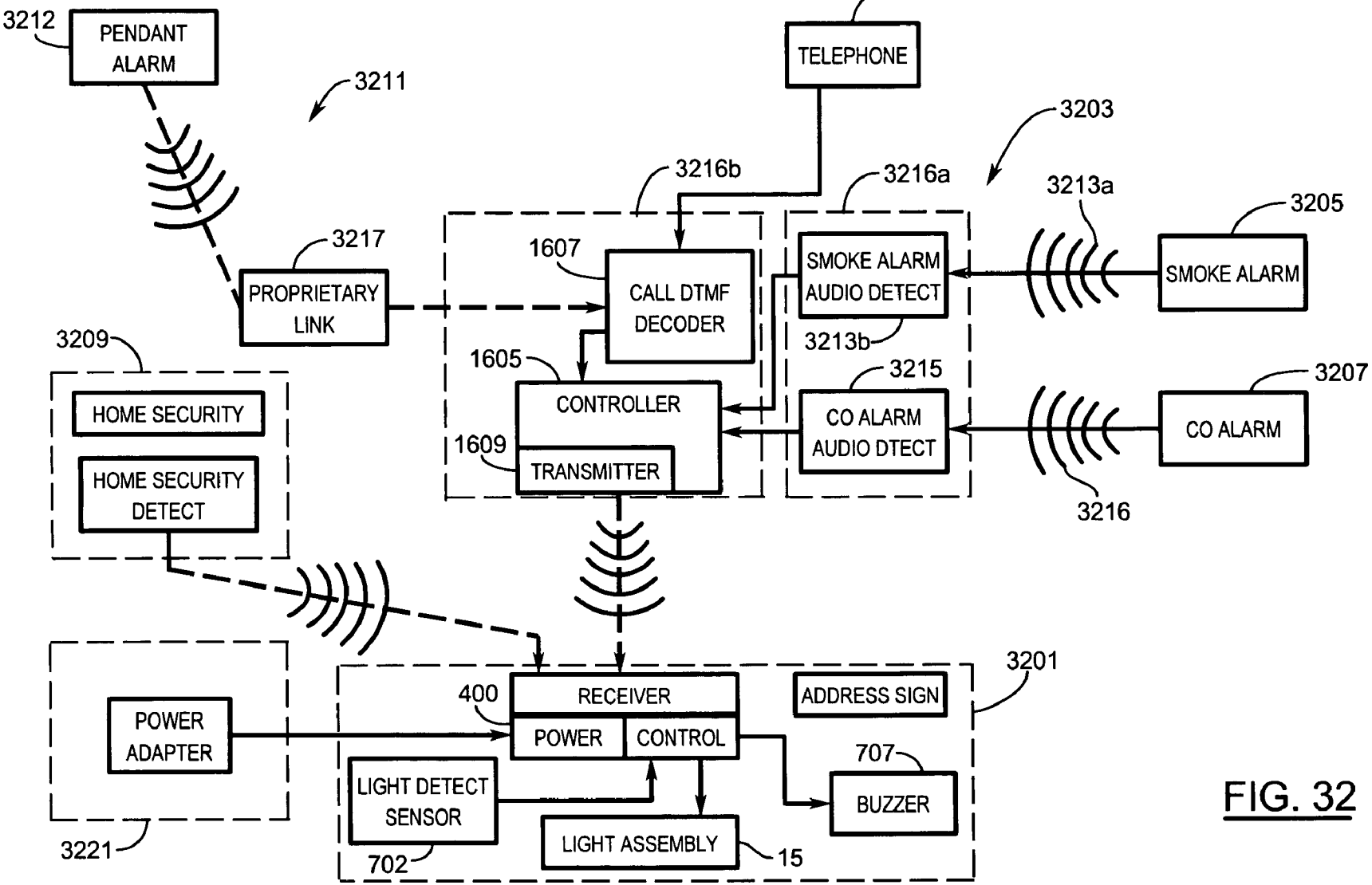
FIG. 32 is a block diagram of an alternate embodiment of the sign of FIG. 1 together with various alarm sources.

Referring to FIG. 32, a sign 3201 and transmitter unit 3203 can be based on the principles described herein for the sign 1 and transmitter unit 1601, while being adapted for other alarm sources, such as a smoke detector 3205, carbon monoxide detector 3207, home security system 3209, or personal alarm 3211 (perhaps including pendants 3212, such as those often worn by patients with potentially debilitating conditions). For the purposes of this description it is assumed that the sign 3201 and transmitter unit 3203 include the same components as the sign 1 and transmitter 3203 with additions for the features and functions to be described herein.

Accordingly the reference numerals from the sign 1 and transmitter 1601 will be used and the corresponding description will not be repeated.

The sign 3201 and transmitter unit 3203 is easy to install and can work with existing alarm sources typically used in homes without rewiring. For example, smoke detector 3205 typically emits an audio tone 3207. The transmitter unit 3203 has a smoke alarm audio detector circuit 3213 that detects the smoke detector audible tone 3207 and passes this information on to the control circuit 1605 to set an alarm condition as previously described with resulting activation of the light sources 21*a*, 21*b* and buzzers 707, 1611. Similarly, the transmitter unit 3203 can have a carbon monoxide alarm audio detector circuit 3215 that detects a carbon monoxide detector audible tone and passes this information on to the controller 1610 to set an alarm condition. The detectors 3213, 3215 can be provided as a separate add-on unit 3216*a* (or units) to a basic transmitter unit 3216*b*, or they could be provided in the same physical unit.

Personal alarms 3211 typically consist of a wireless transmitter pendant 3212 and a wireless receiver link 3217 that is connected to a telephone line and programmed to dial an emergency number, such as a monitoring station, not shown. This type of personal alarm 3211 is simply used with the transmitter 3203, or for that matter with the transmitter unit 1501, by connecting the telephone portion of the link 3217 in line with the transmitter unit 3203, 1501 and programming the number of the monitoring station into the transmitter unit 3203, 1501 in the manner previously described. Thus, when the personal alarm is activated and the monitoring station number is dialled, the transmitter unit 3203, 1501 detects this and an alarm condition is set.

Home security systems 3209 typically have one or more outputs indicating a contact closure (security alarm condition). Transmitter 3203 would then have an input for the home security output. The transmitter 3203 input would be treated as an alarm input and an alarm condition is set as previously described.

A power adapter 3221, previously not shown for the sign 1, is used to provide power to the power circuit 400 as previously described. Similarly, a telephone 3223 is shown for dialling emergency numbers and programming information.

Other alarm sources can be added as desired. As has been described, alarm conditions can be classified as emergency or non-emergency alarms that are differentiated in the activation of the light sources 21*a*, 21*b* and buzzers 707, 1611. Other classifications and activations could be design, including the use of additional colours. It has been found for the preferred embodiment that the particular combination chosen is both simple and effective for most desired circumstance. Systems of greater complexity can be difficult for an untrained user to install and use. Such systems may also be more costly.

It will be understood by those skilled in the art that this description is made with reference to the preferred embodiment and that it is possible to make other embodiments employing the principles of the invention which fall within its spirit and scope as defined by the following claims. For example, the sign 1 can have an output jack (or other connector) to which the TX_DATA from transmitter Unit 1602 can be directly connected to bypass the transmitter circuit 1609. Similarly, the sign 1 can have a jack (or other connector) that bypasses the receiver 705 and provides input directly to the controller 701. Thus a wired connection can be made between the transmitter unit 1602 and the sign 1, for those applications that do not require wireless communications. Such a wired sign can be useful as an emergency signalling device, for example, by putting the sign in one room and the transmitter unit in another room, a person in the first room can alert the person in the second room of an alarm condition by pressing Emergency button 1507. Although, wireless communication can be used, it adds to the cost and may not be required. Similarly, other forms of communication or a combination thereof may be used between the transmitter unit and the sign, such as infrared or optical communication, in appropriate circumstances. As is evident from the foregoing description, for different applications of the sign 1 and the transmitter 1501 it is not necessary to use each of the features of the sign 1 and the transmitter 1501. Such features can be selected as desired for a particular application, while remaining within the principles of the invention and its spirit and scope as defined by the following claims.

We claim:

1. A sign comprising:

a) an opaque housing, b) a radio frequency receiver for receiving messages, c) a character plate, d) a backlight, and e) a sign control circuit, wherein the character plate has an opaque background surrounding one or more translucent characters, the housing has an aperture for the character plate, the housing enclosing the backlight and the control circuit, the backlight for back-lighting the one or more characters, and the control circuit for activating the backlight in response to messages received by the receiver.

2. The sign of claim 1, wherein: the sign is an address sign and the characters are characters of an address.

3. The sign of claim 1, wherein: the sign is an alarm indicator sign and the characters form an alarm message.

4. The sign of claim 1, wherein: the backlight comprises a light diffusion chamber and a light assembly wit one or more light sources for side-lighting the diffusion chamber.

5. The sign of claim 4, wherein: the housing comprises abase and a frame that form the light diffusion chamber, the base having a reflective face opposite the housing aperture with the light assembly between the base and the plate, the frame surrounding and having the same colour as the plate background, and the frame attached to the base so as not to block light from the light assembly entering the diffusion chamber.

6. The sign of claim 5, further comprising a casing that encloses the base and frame and retains the character plate against the frame, while providing an aperture through which the characters are visible.

7. A sign according to claim 8 wherein the casing and character plates are provided detached from other components of the sign for later assembly.

8. The sign of claim 7, further including a transmitter unit comprising:

a) an alarm detector, b) a radio frequency transmitter circuit, c) a transmitter control circuit, and d) a transmitter housing for housing the transmitter circuit and transmitter control circuit, wherein the transmitter control is for recognizing alarms detected by the alarm detector and sending messages to the transmitter circuit in response to a detected alarm, and the transmitter circuit is for transmitting those messages over radio frequencies.

9. The sign of claim 5, wherein the frame further comprises a shelf extending partially in front of the diffusion chamber to support the character plate is in front of the diffusion chamber.

10. The sign of claim 9, wherein the frame further comprises a shelf rim extending outwardly about the shelf to bold the character plate in front of the shelf.

11. The sign of claim 10, further comprises a flange extending from the frame rim in front of the shelf for retaining the character plate between the shelf and the flange within the frame rim.

12. The sign of claim 11, further comprising a casing that encloses the base and frame and retains the character plate against the frame, while providing an aperture through which the characters are visible.

13. The sign of claim 12, wherein the frame further comprises a supra-rim about the frame rim to provide a rim slot, and wherein the casing has a tongue extending rearward that fits into the rim slot.

14. The sign of claim 4, wherein the light sources are light emitting diodes (LEDs).

15. The sign of claim 14, wherein the light assembly comprises the LEDs mounted on one or more light circuit printed circuits boards.

16. The sign of claim 4, wherein the sources are alternating LEDs of two different colours, one colour for use in indicating an emergency alarm condition, the other colour used to illuminate the characters in low light conditions.

17. The sign of claim 16, wherein the emergency colour is red arid the other colour is yellow.

18. The sign of claim 15, wherein the light circuit printed circuit boards are retained in slots in the base.

19. The sign of claim 18, wherein the light assembly further comprises a power circuit on a power circuit printed circuit board that is mounted in slot in the base perpendicular to the light circuit printed circuit boards, and the light circuit printed circuit boards plug into the power circuit printed circuit board for power.

20. The sign of claim 19, wherein the sign control circuit is on a printed circuit board and the control circuit printed circuit board also plugs into the power circuit printed circuit board for controlling power to the power circuit for controlling activation of the light sources.

21. The sign of claim 20 wherein the control circuit has a light sensor and the control circuit printed circuit board is located in a pocket of the housing optically separated from the light sources.

22. The sign of claim 1, wherein: the control circuit recognizes a radio frequency alarm message and activates the backlight in response to the alarm message.

23. The sign of claim 1, wherein: the control circuit recognizes a radio frequency emergency alarm message and activates the backlight in an emergency mode in response to an emergency alarm message.

24. The sign of claim 23, wherein: the control circuit also recognizes a radio frequency non-emergency alarm message and activates the backlight in a non-emergency mode different from the emergency mode in response to a non-emergency alarm message.

25. The sign of claim 1, wherein: the control circuit recognizes radio frequency messages that are addressed to it.

26. The sign of claim 25, wherein: the control circuit recognizes broadcast address messages for learning a specific address for the sign from the broadcast address message.

27. The sign of claim 1, wherein the sign has a relatively small depth when compared to its width and height to create a low profile.

28. The sign of claim 1, wherein the sign has a depth of approximately one inch.

29. A sign and transmitter combination comprising a sign according to claim 1 and a transmitter unit comprising:

a) an alarm detector, b) a radio frequency transmitter circuit, c) a transmitter control circuit, and d) a transmitter housing for housing the transmitter circuit and transmitter control circuit, wherein the transmitter control is for recognizing alarms detected by the alarm detector and sending messages to the transmitter circuit in response to a detected alarm, and the transmitter circuit is for transmitting those messages over radio frequencies.

30. A sign comprising:

a) an opaque housing, b) a character plate, c) a backlight, and d) a sign control circuit, wherein the character plate has an opaque background surrounding one or more translucent characters, the housing having an aperture for the character plate, the housing enclosing the backlight and the control circuit, and the control circuit for activating the backlight when there is low light external to the sign, the backlight for back-lighting the one or more characters, and the backlight comprises a light diffusion chamber and a light assembly with one or more light sources for side-lighting the diffusions chamber, and the housing comprises a base and a frame that form the light diffusion chamber, the base having a reflective face opposite the housing aperture with the light assembly between the base and the plate, the frame surrounding and having the same colour as the plate background, and the frame attached to the base so as not to block light from the light assembly entering the diffusion chamber.

31. A sign comprising:

a) an opaque housing, b) a character plate, c) a backlight, d) a sign control circuit, and e) a receiver for receiving messages, wherein the character plate has an opaque background surrounding one or more translucent characters, the housing having an aperture for the character plate, the housing enclosing the backlight and the control circuit, and the control circuit for activating the backlight, and wherein the control circuit activates the backlight in response to messages received by the receiver.

32. The sign of claim 31 wherein the receiver is a wireless receiver.

33. The sign of claim 32 wherein the receiver is a radio frequency wireless receiver.

34. The sign of claim 31 wherein the receiver is a wired input.

35. A sign and transmitter combination comprising a sign according to claim 31 and a transmitter unit comprising:

a) an alarm detector, b) a transmitter control circuit, and c) a transmitter housing for housing the transmitter circuit and transmitter control circuit, wherein the transmitter control is for recognizing alarms detected by the alarm detector, and the transmitter is for transmitting those messages to the sign.

* * * * *

UNITED STATES PATENT AND TRADEMARK OFFICE

CERTIFICATE OF CORRECTION

PATENT NO. : 7,012,544 B2
APPLICATION NO. : 10/409149
DATED : March 14, 2006
INVENTOR(S) : Gomes, Michael and Cunningham, J. Vern It is certified that error appears in the above-identified patent and that said Letters Patent is hereby corrected as shown below:

Column 19,

Line 23, replace "A sign according to claim 8" with -- A sign according to claim 6, --.

Signed and Sealed this

Twenty-ninth Day of August, 2006

JON W. DUDAS
*Director of the United States Patent and Trademark Office*